US009931861B2

(12) United States Patent
Fukazawa et al.

(10) Patent No.: US 9,931,861 B2
(45) Date of Patent: Apr. 3, 2018

(54) PRINTING CONTROL APPARATUS AND PRINTING CONTROL METHOD

(71) Applicant: Seiko Epson Corporation, Tokyo (JP)

(72) Inventors: Masahiro Fukazawa, Chino (JP); Akito Sato, Matsumoto (JP); Naoki Sudo, Shiojiri (JP); Hiroki Sato, Minowa-Machi (JP)

(73) Assignee: Seiko Epson Corporation, Tokyo (JP)

( * ) Notice: Subject to any disclaimer, the term of this patent is extended or adjusted under 35 U.S.C. 154(b) by 26 days.

(21) Appl. No.: 15/004,013

(22) Filed: Jan. 22, 2016

(65) Prior Publication Data

US 2016/0229178 A1 Aug. 11, 2016

(30) Foreign Application Priority Data

Feb. 9, 2015 (JP) ..... 2015-022929

(51) Int. Cl.
*B41J 2/165* (2006.01)
*B41J 2/21* (2006.01)

(52) U.S. Cl.
CPC ..... *B41J 2/2132* (2013.01); *B41J 2/2139* (2013.01); *B41J 2/2142* (2013.01)

(58) Field of Classification Search
None
See application file for complete search history.

(56) References Cited

U.S. PATENT DOCUMENTS 8,480,200 B2 * 7/2013 Hirano ..... B41J 2/2132 347/14
2007/0013729 A1 * 1/2007 Jung ..... B41J 29/393 347/12
2008/0253779 A1 10/2008 Torii

FOREIGN PATENT DOCUMENTS

JP 2005-246840 A 9/2005
JP 2008-194855 A 8/2008

* cited by examiner

*Primary Examiner* — Alejandro Valencia

(57) ABSTRACT

A printing control apparatus includes a defective nozzle detecting section that detects a defective nozzle included in the plurality of nozzles; and a complementing section that forms a complementary dot which complements dots of a first raster to be recorded using the defective nozzle on at least one of a second raster and the first raster using a complementary nozzle included in the plurality of nozzles. The complementing section includes an adjusting section which sets main scanning being performed after the defective nozzle is detected as a first main scanning, sets main scanning being performed M times after the defective nozzle is detected as a M-th main scanning, and allows a usage rate of ink in the first main scanning to be greater than a usage rate of ink in the M-th main scanning, regarding the usage rate of ink discharged using the same complementary nozzle.

9 Claims, 16 Drawing Sheets

PRINTING CONTROL APPARATUS AND PRINTING CONTROL METHOD

BACKGROUND

1. Technical Field

The present invention relates to a printing control apparatus and a printing control method.

2. Related Art

The ink jet printer, for example, reciprocates a plurality of nozzles, which are arranged in a predetermined nozzle arrangement direction, and an object to be printed in a reciprocation direction intersecting with the nozzle arrangement direction, discharges ink droplets (liquid droplets) from nozzles according to nozzle data which indicates presence or absence of dots in each pixel so as to form dots onto the object to be printed. The ink jet printer which performs multipath printing repeats main scanning and sub scanning so as to form dots in each raster by passing (main scanning) twice or more. As a representative example of such an ink jet printer, there is a serial printer.

When the ink droplets are not discharged from the nozzle or a trace of the discharged ink droplets is not correctly drawn due to clogging or the like in the serial printer, a "dot missing" raster connecting to the pixel on which the dots are not formed in the main scanning direction is formed, so that a line such as a white line is generated in the printed image. In order to suppress such a line, a complementary dot, which complements dots to be formed using a defective nozzle which is defected to form dots, is formed using the complementary nozzle. In the ink jet printer which performs the multipath printing, the complementary nozzle which can be used for forming dots on the "dot missing" raster is present, and thus, the complementary dot can be formed by discharging the ink droplets from the complementary nozzle. An ink jet recording apparatus disclosed in JP-A-2005-246840 confirms a non-discharging nozzle before printing, and distributes and allocates recording of the pixel which is recorded using the non-discharging nozzle in the multipath printing of a three-pass or more to a plurality of fungible nozzles.

The defective nozzle may be generated during printing. Here, it is preferable that the complementary dot is formed when the defective nozzle is generated during printing. In the ink jet recording apparatus described above, when the non-discharging nozzle is generated during printing without confirming the non-discharging nozzle before printing, a line such as a white line is generated in the printed image. Moreover, such a problem is also present on various printing apparatuses.

SUMMARY

An advantage of some aspects of the invention is to provide a technology that is capable of appropriately complementing dots to be formed using the defective nozzle.

According to an aspect of the invention, there is a provided a printing control apparatus for a printing section that repeats main scanning in which a plurality of nozzles discharging ink droplets and an object to be printed are reciprocated in a main scanning direction, reciprocates the plurality of nozzles and the object to be printed in a sub scanning direction between one and the other of the main scanning, and forms dots of a raster in the main scanning direction by performing the main scanning M times (M is integer of two or more), the apparatus includes a defective nozzle detecting section that detects a defective nozzle included in the plurality of nozzles, and a complementing section that forms a complementary dot which complements dots of a first raster to be recorded using the defective nozzle on at least one of a second raster and the first raster using a complementary nozzle included in the plurality of nozzles, in which the complementing section includes an adjusting section which sets main scanning being performed after the defective nozzle is detected as a first main scanning, sets main scanning being performed M times after the defective nozzle is detected as a M-th main scanning, and allows a usage rate of ink in the first main scanning to be greater than a usage rate of ink in the M-th main scanning, regarding the usage rate of ink discharged using the same complementary nozzle.

In addition, according to another aspect of the invention, there is also provided a printing control method for a printing section that repeats main scanning in which a plurality of nozzles discharging ink droplets and an object to be printed are reciprocated in a main scanning direction, reciprocates the plurality of nozzles and the object to be printed in a sub scanning direction between one and the other of the main scanning, and forms dots of a raster in the main scanning direction by performing the main scanning M times (M is integer of two or more), the method includes detecting a defective nozzle included in the plurality of nozzles, and forming a complementary dot which complements dots of a first raster to be recorded using the defective nozzle on at least one of a second raster and the first raster using a complementary nozzle included in the plurality of nozzles, in which the forming includes setting main scanning which is performed after the defective nozzle is detected as a first main scanning, setting main scanning which is performed M times after the defective nozzle is detected as a M-th main scanning, and allowing a usage rate of ink in the first main scanning to be greater than a usage rate of ink in the M-th main scanning, regarding the usage rate of ink discharged using the same complementary nozzle.

In this case, provided is a technology which is capable of appropriately complementing the dots to be formed using the defective nozzle.

Further, the invention can be adopted to a printing apparatus including the printing control apparatus, a printing method including the printing control method, a printing control program which allows functions corresponding to the described above configuration components to be realized using a computer, a printing program including the printing control program, a medium in which such a program, which can be read by a computer, is recorded, and the like. The above described apparatus may be configured to a plurality of distributed parts.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described. Of course, the embodiments described below only exemplify the invention, and all features described in the embodiments do not need to be units of the invention.

1. Outline of Technology

First, an outline of a technology will be described with reference to FIG. 1 to FIG. 16. Moreover, FIG. 1 to FIG. 16 are schematic diagrams, and drawings may not match each other.

Figure 1:
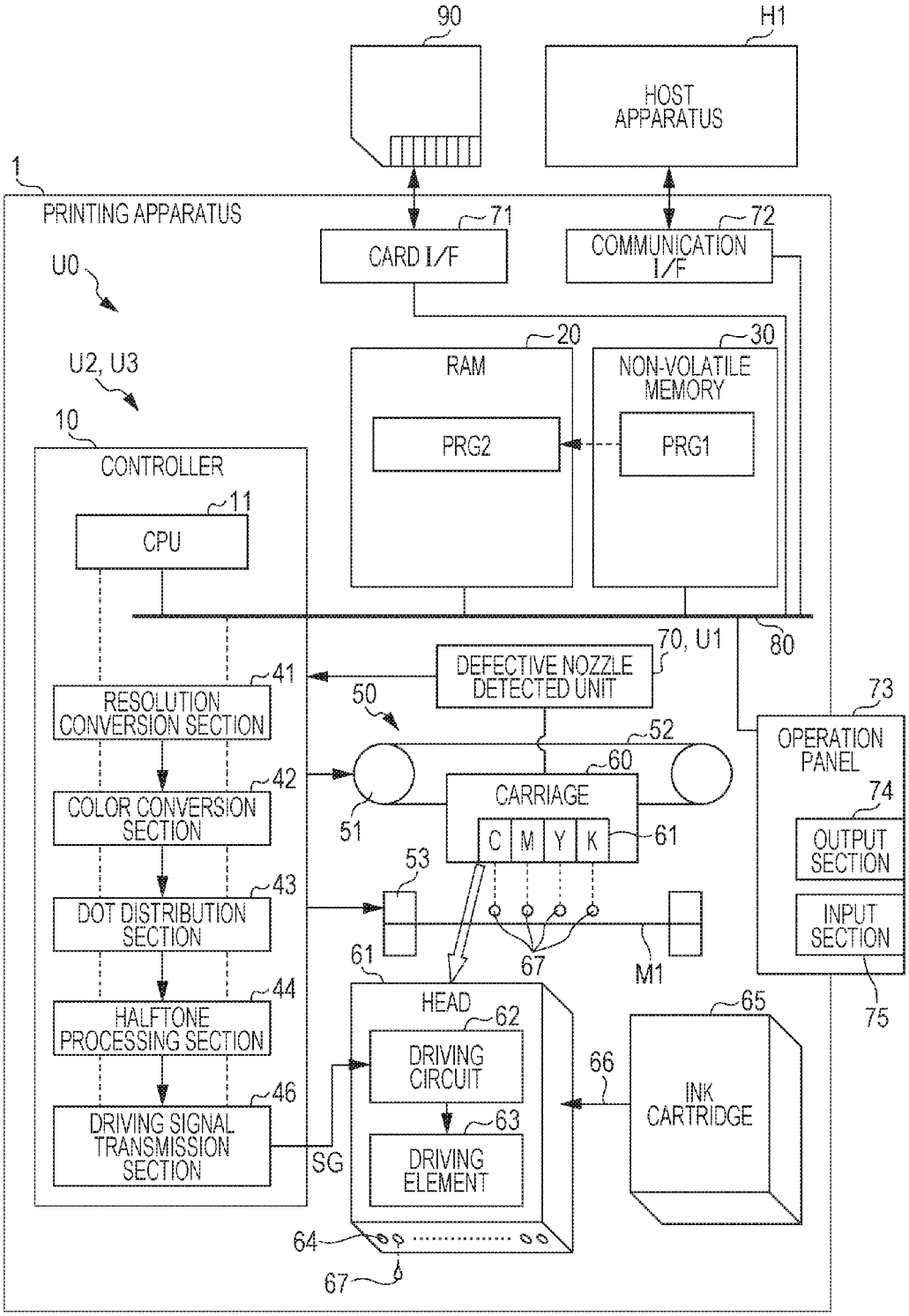
FIG. 1 is a diagram schematically illustrating a configuration example of a printing apparatus.
Figure 2:
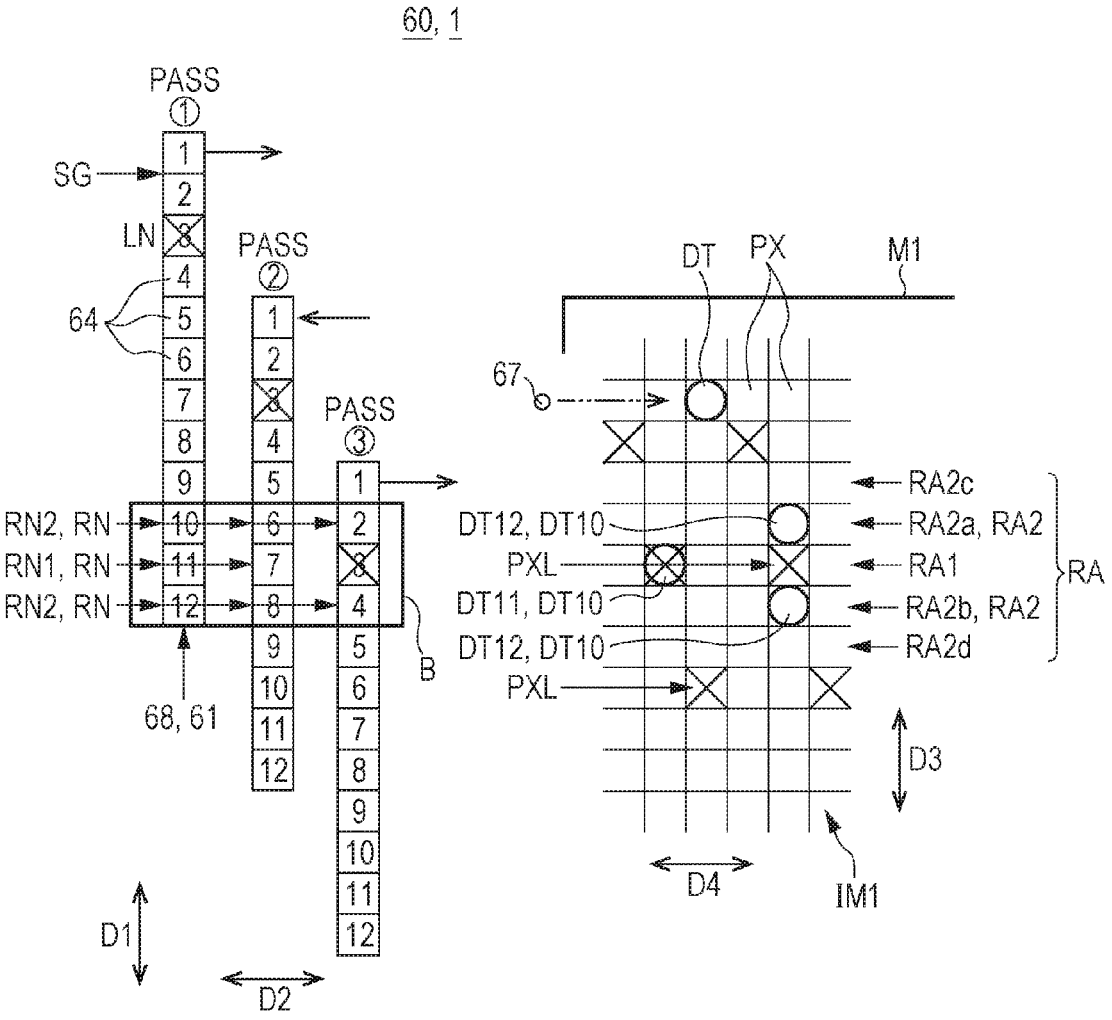
FIG. 2 is a diagram schematically illustrating an example of corresponding relationship of a nozzle and a raster.

In a printing apparatus (printing section) 1 exemplified in FIG. 1, FIG. 2, or the like, a plurality of nozzles 64 which discharges ink droplets 67 and an object to be printed M1 are repeatedly relatively moved in a main scanning direction D2, the plurality of nozzles 64 and the object to be printed M1 between one and the other of the main scanning are relatively moved in a sub scanning direction D3, and dots DT of a raster RA in the main scanning direction D2 are formed by performing the main scanning M times (M is an integer of two or more). A printing control apparatus U0 includes a defective nozzle detecting section U1 and a complementing section U2. The defective nozzle detecting section U1 detects a defective nozzle LN which is surrounded by the plurality of nozzles 64. The complementing section U2 allows a complementary dot DT10, which complements a dot of the first raster RA1 which is need to be recorded by the defective nozzle LN, to be formed at least one of the second raster RA2 and the first raster RA1 by complementary nozzles RN included in the plurality of the nozzles 64. The complementing section U2 sets main scanning being performed after the defective nozzle LN is detected to a first main scanning P1, sets main scanning being performed M times after the defective nozzle LN is detected to a M-th main scanning PM, regarding a usage rate of ink (disclosed as ink usage rate) discharged using the same complementary nozzle RN. The complementing section includes an adjusting section U3 which allows the usage rate of ink in the first main scanning P1 to be greater than the usage rate of ink in the M-th main scanning PM.

In addition, a printing control method being performed in the printing apparatus 1 includes a defective nozzle detecting process corresponding to the defective nozzle detecting section U1, and a complementing process corresponding to the complementing section U2. The complementing process includes an adjusting process corresponding to the adjusting section U3.

Figure 6:
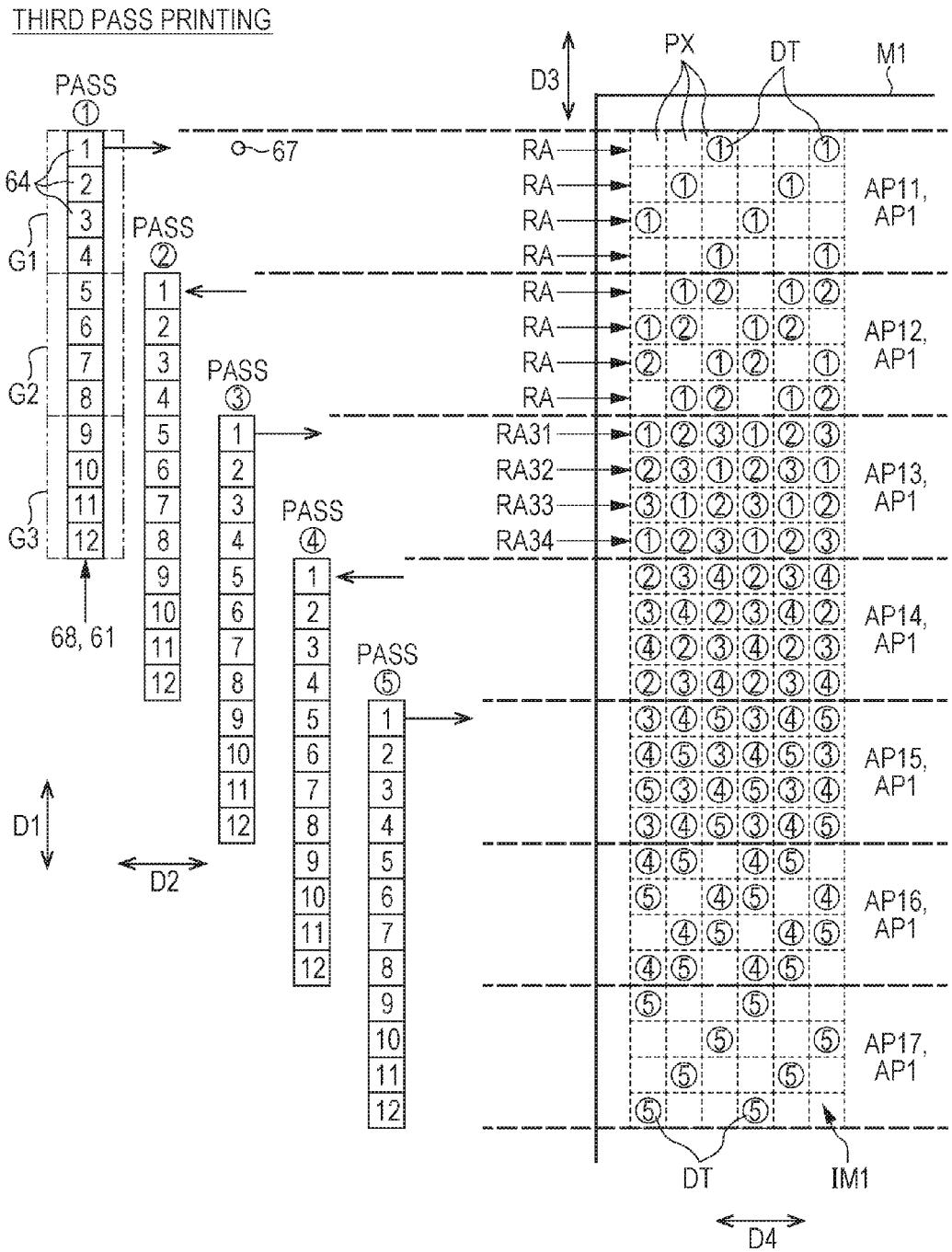
FIG. 6 is a diagram schematically illustrating an example of a nozzle position and a dot position for each main scanning.

First, as illustrated in FIG. 6, it is described which pass (main scanning) is used for forming the dots DT onto some position of the object to be printed M1 at the time of multipath printing. FIG. 6 schematically illustrates an example of performing three-pass printing in a bidirectional printing in which the ink droplets (liquid droplets) 67 are discharged from the nozzle 64 of a recording head 61 in a main direction (rightward direction in FIG. 6) and a sub direction (leftward direction in FIG. 6 of the main scanning direction D2. For the sake of clear description, twelve nozzles 64 are arranged in the nozzle row 68 of the head 61 in the arrangement direction D1, each of the nozzles is given a number of 1 to 12, the four nozzles are fed for every four pass, circled numbers of a circle 1 to a circle 5 indicate each pass, the circled numbers of the circle 1 to the circle 5 indicate that the dots DT are formed on each pixel PX of a printed image IM1, in something-th pass. In this case, the raster RA in which a formation of the dots DT in each pass is terminated is every fourth raster, and a printing region AP1 of the four raster unit is identified using symbols AP11 to AP17. For example, in the printing region AP13, the dots DT (for example, middle dots) are formed using the ink droplets 67 discharged from 9-th to 12-th nozzles of the pass 1, 5-th to 8-th nozzles of the pass 2, and 1-st to 4-th nozzles of the pass 3. Regarding the raster RA31 in which the dots DT are formed using the 9-th nozzle of the pass 1, 5-th nozzle of the pass 2, and 1-st nozzle of the pass 3, the usage rate of ink at the time of forming the same sized dots DT (for example, medium dots) on all pixels PX is set to 100%, and as the same usage rate in each pass, any of the usage rates of ink discharged from the 9-th, 5-th, and 1-st nozzles are set to substantially 33%. It is the same as the other rasters RA32 to RA34 inside the printing region AP13, and the other printing region AP1 is also the same as that of.

Figure 14:
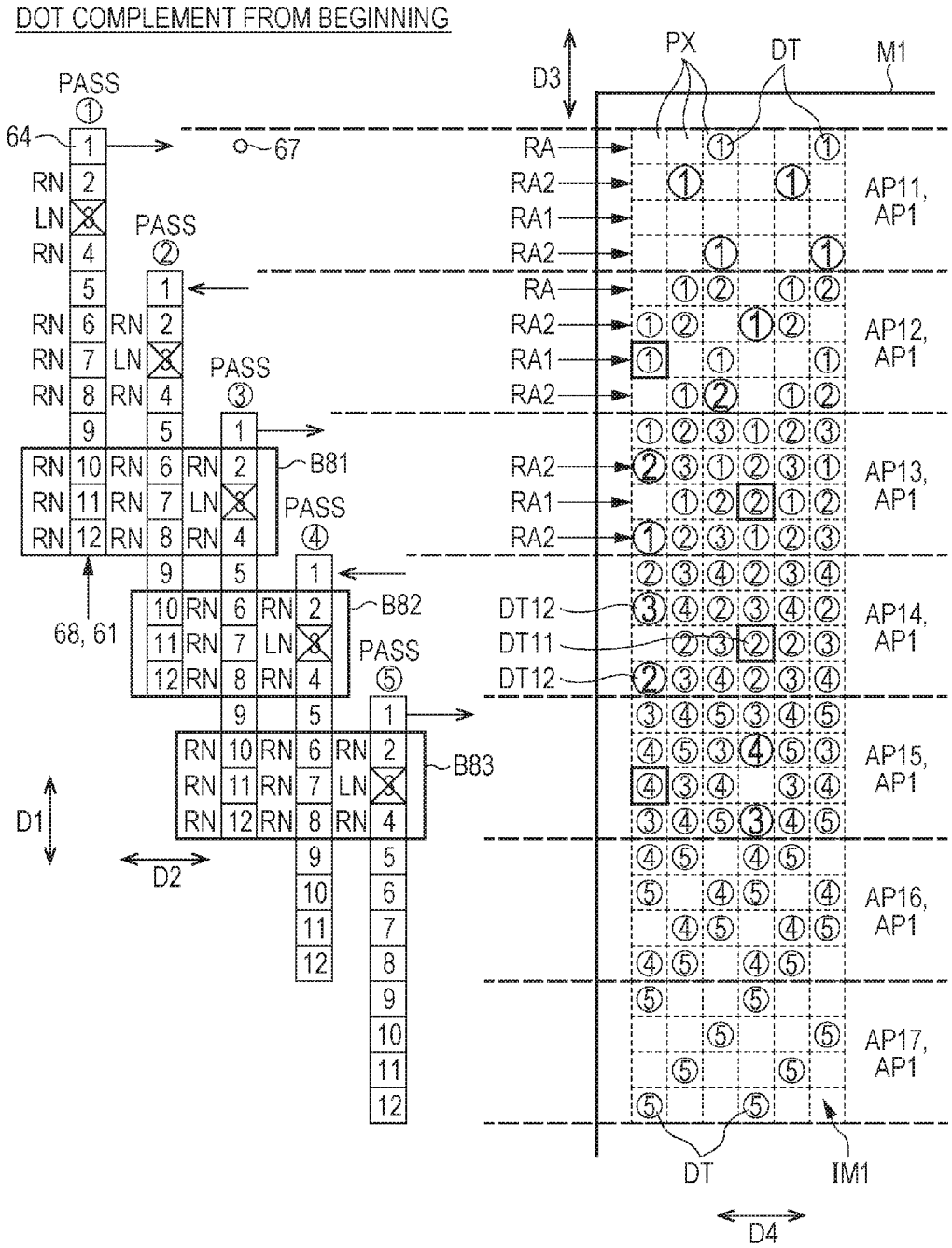
FIG. 14 is a diagram schematically illustrating an example of the dot complementing at the time of detecting a defective nozzle before printing.

Here, as illustrated in FIG. 14, it is detected that the 3-rd nozzle is the defective nozzle LN before printing. In this case, from the beginning, the complementary dots DT11 and DT12 can be formed by the complementary nozzles RN (inside blocks B81 to B83). Here, the complementary dot DT11 is formed on the first raster RA1 to be recorded by the defective nozzle LN, and the complementary dot DT12 is formed on the second raster RA2 (for example, raster adjacent to first raster RA1) different from the first raster RA1. For the sake of clear description, an X symbol is given to the defective nozzle LN, the complementary dot DT11 of the first raster RA1 is illustrated to be surrounded by thick lines of a square shape, and the complementary dot DT12 (for example, large dot) in which a size thereof is increased is illustrated by a larger circle number. For example, the complementary dot DT11 of the printing region AP13 is formed using the 7-th nozzle of the pass 2, and the complementary dots DT12 (two) of the printing region AP13 are formed using the 12-th nozzle of the pass 1 and the 6-th nozzle of the pass 2.

Figure 15:
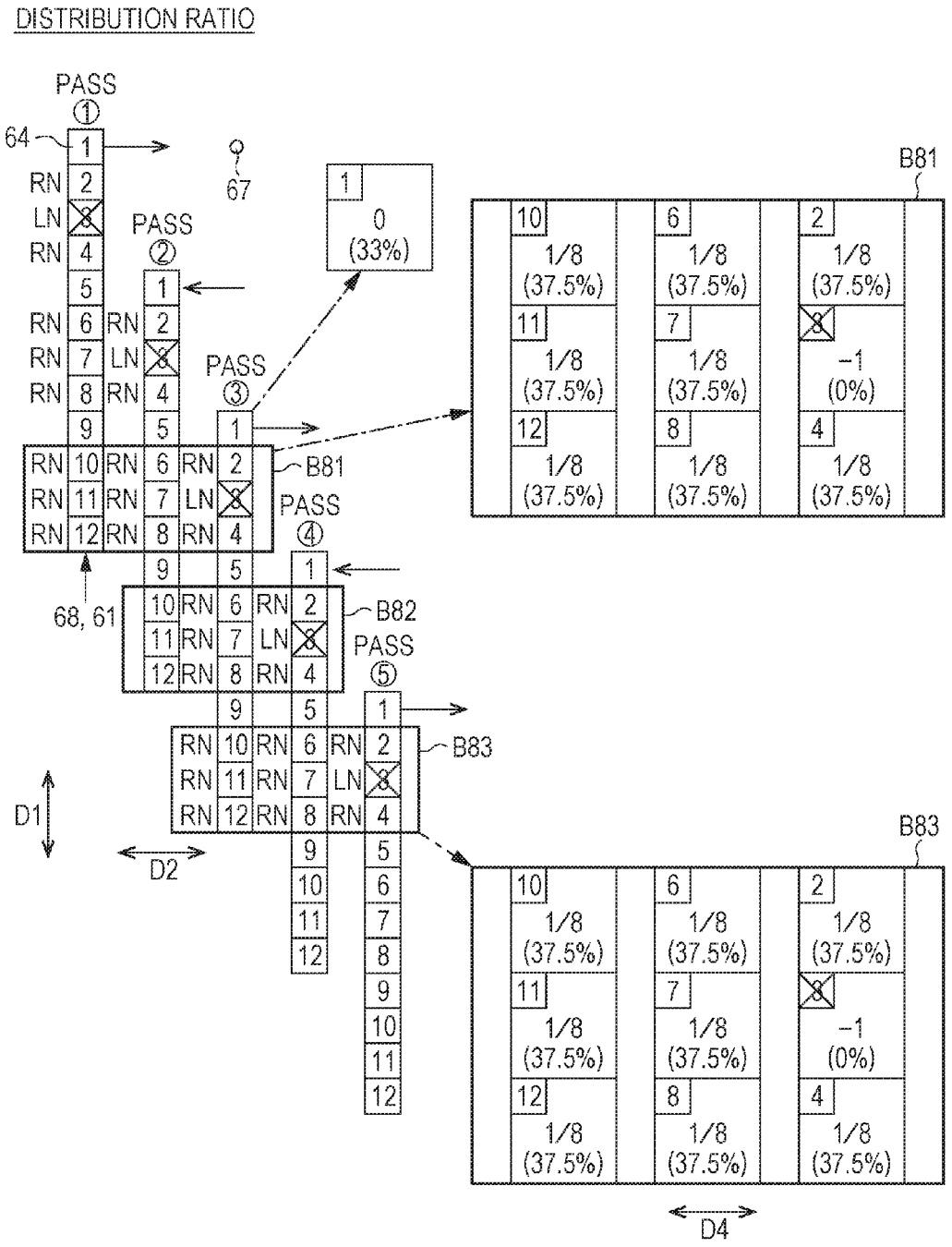
FIG. 15 is a diagram schematically illustrating an example of the distribution ratio of the used amount of ink for forming the complementary dot in a case in which the defective nozzle is detected before printing and the usage rate of ink after the distribution.

FIG. 15 schematically illustrates examples of distribution ratio of the used amount of ink for forming the complementary dots DT11 and DT12, and the usage rate of ink of after the distribution. In right side of FIG. 15, the used amount of the ink to be discharged from the defective nozzle LN is illustrated by a rate in which the used amount is distributed in the eight complementary nozzles RN in the blocks B81 and B83, and hereinafter, the usage rate corresponding to the distribution ratio, which is added to substantially 33% of the primary usage rate of ink, is illustrated by parentheses. In this example, substantially 33% of the usage rate of ink to be discharged from the 3-rd nozzle, which is the defective nozzle LN, is evenly distributed to the eight complementary nozzles RN inside the blocks B81 to B83 as ⅛, and the usage rate of ink of the eight complementary nozzles RN is set to substantially 37.5% from substantially 33% of an original rate. After the pass 3, the distribution ratio of with respect to the eight complementary nozzles RN is constant.

Figure 16:
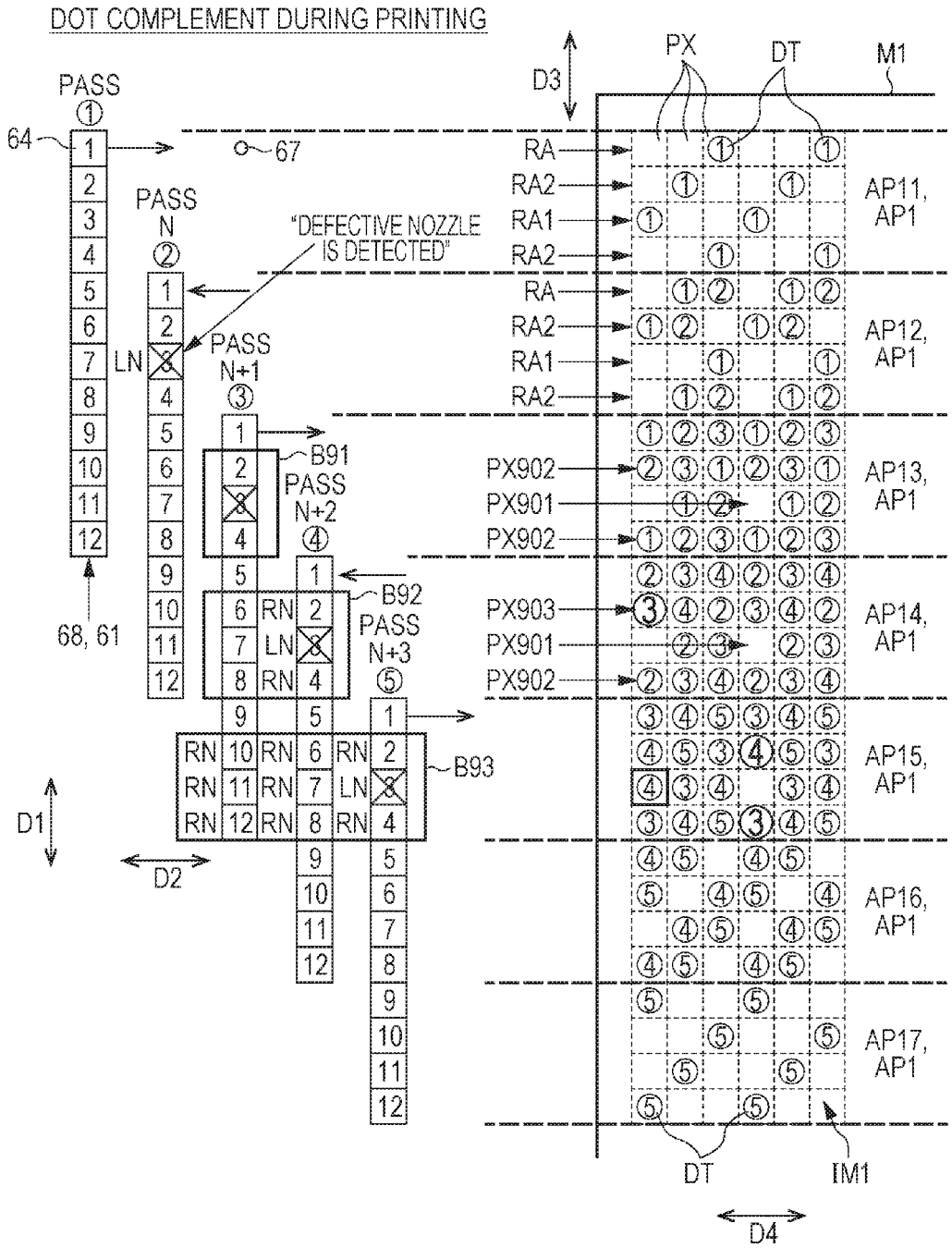
FIG. 16 is a diagram schematically illustrating an example of the dot complementing at the time of detecting a defective nozzle during printing in a comparative example.

However, as illustrated in FIG. 16, when the defective nozzle LN is generated during printing (for example, pass 2), the dot complementing is insufficient for a while after the defective nozzle LN is detected. For example, since the defective nozzle LN is detected in the pass 2, when the dot of the printing region AP13 is completely formed in the pass 3 in which a subsequent main scanning is performed, the 5-th to 12-th nozzles used in the passes 1 and 2 cannot be used for the dot complementing, but only the 2-nd to 4-th nozzles in the block B91 can be used. For this reason, the dot is not formed in a pixel PX901 in which the complementary dot DT11 needs to be formed using the 7-th nozzle of the pass 2. In addition, a dot having an original size is not formed in the pixel PX902 in which the complementary dot DT12 having an increased size needs to be formed using the 12-th nozzle of the pass 1 and the 6-th nozzle of the pass 2. When the dot is completely formed on the printing region AP14 in the pass 4 in which second main scanning is performed after the defective nozzle LN is detected in the pass 2, the 6-th to 8-th nozzles (inside block B92) in the pass 3 can be used, and thus, the complementary dot DT12 can be formed on the pixel PX903 preset in the second raster RA2 using the pass 3. However, the 10-th to 12-th nozzles in the pass 2 cannot be used for the dot complementing. When the printing region AP15 is formed in the pass 5 in which third main scanning is performed after the defective nozzle LN is detected in the pass 2, the eight complementary nozzles RN in the block B93 can be used.

As described in the examples above, when the dots DT of the raster RA are formed by performing the main scanning M times, if the defective nozzle LN is detected in the pass N, the dot complementing is insufficient until the pass N+1 (including pass N+1), which is subsequently performed after the defective nozzle LN is detected, and the pass N+M−1 is terminated.

Figure 8:
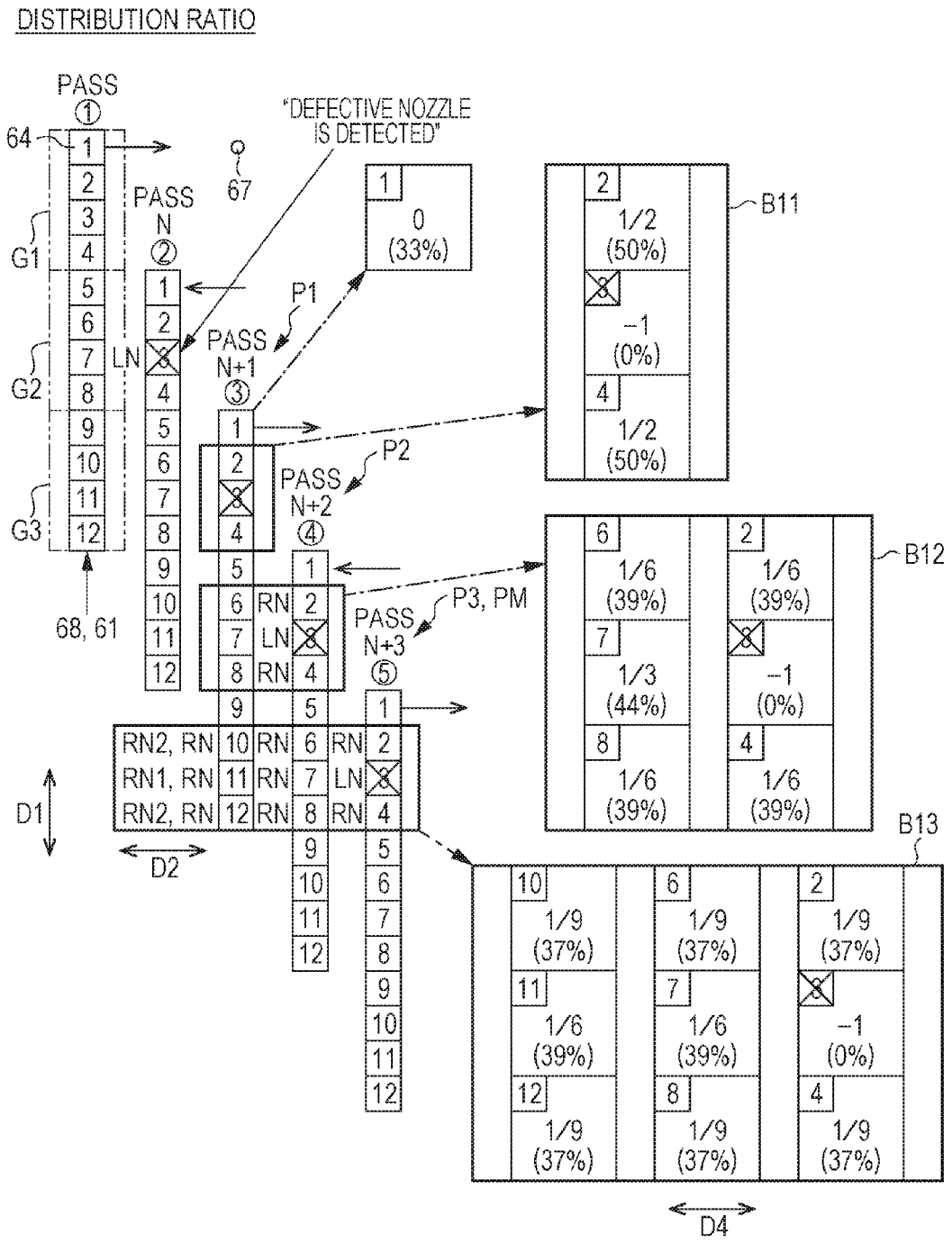
FIG. 8 is a diagram schematically illustrating an example of a distribution ratio of a used amount of ink for forming a complementary dot and a usage rate of ink after distribution.

In the technology, as illustrated in FIG. 8, and the like, regarding the usage rate of ink discharged from the same complementary nozzle RN, the usage rate of ink of the first main scanning P1 which is performed after the defective nozzle LN is detected, is greater than the usage rate of ink of the M-th main scanning PM which is performed M times. Accordingly, the dot complementing is increased more than the M-th main scanning PM in the first main scanning P1, and insufficiency of the dot complementing is controlled. Therefore, the technology is capable of further suitably complementing dots to be formed using the defective nozzle.

Here, the nozzle is a small hole which discharges the ink droplets. In the ink droplets, uncolored ink which is a so-called ink droplet for improving an image quality, and the like are included.

The object to be printed (print substrate) is a material in which the printed image is maintained. A shape thereof is generally rectangle; however, there are a circular shape (for example, optical disk such as CD-ROM and DVD), a triangle shape, a square shape, a polygonal shape, and the like, and at least, all types of paper and paperboards and manufactured products disclosed in JIS (Japanese industrial standards) P0001:1998 (paper·paperboards and pulp terms) are included. Resin sheets, metal plates, solid objects, and the like are also included in types of the objects to be printed.

In relative movement of the plurality of nozzles and the object to be printed, the object to be printed is moved without moving the plurality of nozzles, the plurality of nozzles are moved without moving a recording object to be printed, and both of the plurality of nozzles and the object to be printed are moved. As a representative example of the printing apparatus in which the plurality of nozzles are moved without moving the object to be printed at the time of forming the dot by discharging the ink droplets, a serial printer is exemplified.

The raster means an arrangement of the pixels which are continuous in a row of in the main scanning direction.

When discharging of the ink droplets is not normally performed, there is clogging, which is a phenomenon in which the nozzle is blocked.

When the defective nozzle is detected after any main scanning is terminated before next main scanning is performed, main scanning, which is performed after the defective nozzle is detected, is "subsequent main scanning", and main scanning, which is performed M-th after the defective nozzle is detected, is M-th main scanning which counts the "subsequent main scanning" as first time. In addition, when the defective nozzle is detected during main scanning, main scanning, which is performed after the defective nozzle is detected, is subsequent main scanning of the "any main scanning", and main scanning, which is performed M-th after the defective nozzle is detected, is M-th main scanning which is counted the "subsequent main scanning" as first time.

The usage rate of ink is set to a ratio of an amount of the ink which is discharged from the nozzles against an amount of the ink discharged from the rasters of a recording target in a case in which the printed image having a constant recording density is formed. The usage rate of ink discharged from the complementary nozzle increases as much as the complementary dots are formed.

Regarding an increase of the usage rate of ink, both of increasing the number of dots per unit area and increasing a size of the dot are included.

When there are multiple complementary nozzles, the adjusting section may allow the usage rate of ink in the first main scanning in regard to the complementary nozzle to be larger than the usage rate of ink in the M-th main scanning. Accordingly, in the plurality of complementary nozzles, a complementary nozzle, which have the same the usage rate of ink in the first main scanning as the usage rate of ink the M-th main scanning, may be included.

In the meantime, as illustrated in FIG. 8, and the like, the adjusting section U3 may allow the usage rate of ink in the first main scanning P1 to be greater than the usage rate of ink in the second main scanning P2, by setting subsequent main scanning of the first main scanning P1 as the second main scanning P2, regarding the usage rate of ink discharged from the same complementary nozzle RN. Accordingly, the dot complementing increases more in the second main scanning P2 than the first main scanning P1, and an insufficiency of the dot complementing is suppressed. Therefore, an aspect of the invention is to provide a technology which is capable of suitably complementing the dot to be formed by the defective nozzle.

The M times may mean three times, or more. The adjusting section U3 may allow the usage rate of ink in the second main scanning P2 to be greater than the usage rate of ink in the third main scanning P3 by setting subsequent main scanning of the second main scanning P2 as the third main scanning P3, regarding the usage rate of ink discharged using the same complementary nozzle RN. Accordingly, the dot complementing increases more in the third main scanning P3 than the second main scanning P2, and the insufficiency of the dot complementing is suppressed. Therefore, the aspect of the invention is to provide a technology which is capable of suitably complementing the dot to be formed by the defective nozzle.

The adjusting section U3 may allow the usage rate of ink in main scanning after the M-th main scanning PM to remain constant with respect to the usage rate of ink discharged using the same complementary nozzle RN. Accordingly, the dot complementing is suitably performed in main scanning after the M-th main scanning PM. Therefore, the aspect of the invention is to provide a technology which is capable of further suitably complementing the dot to be formed by the defective nozzle.

Here, in main scanning after the M-th main scanning, the M-th main scanning is also included.

The complementary nozzles RN may include a first raster complementary nozzle RN1 which is used for forming the complementary dot DT11 on the first raster RA1 and a second raster complementary nozzle RN2 which is used for forming the complementary dot DT12 on the second raster RA2. The adjusting section U3 may allow the usage rate of ink discharged using the first raster complementary nozzle RN1 in the same main scanning to be greater than the usage rate of ink discharged using a second raster complementary nozzle RN2. Accordingly, the complementary dot DT11, which is to be recorded on the first raster RA1 using the defective nozzle LN, increases. Therefore, the aspect of the invention is to provide a technology which is capable of suitably complementing the dot to be formed by the defective nozzle.

2. Specific Example of Configuration of Printing Apparatus

FIG. 1 schematically illustrates a configuration example of a serial printer which is a type of the ink jet printer as the printing apparatus 1. FIG. 2 schematically illustrates an example of a corresponding relationship of the nozzle 64 and the raster RA in the printing apparatus 1 as illustrated in FIG. 1. The printing apparatus 1 includes, as illustrated in FIG. 2, the printing section, in which the recording head 61 and the object to be printed M1 are relatively moved, and the printing control apparatus U0, which controls the printing section. The printing apparatus is capable of performing M pass printing (M is an integer of two or more). It will be described in detail later, the printing control apparatus U0 is provided with the complementing section U2 which includes the adjusting section U3 for suppressing the insufficient of the dot complementing in the pass (main scanning) from detecting the defective nozzle LN to performing a M−1-th main scanning which is performed M−1-th. First, a specific example of a serial printer, which includes an appropriate configuration for suppressing insufficiency of the dot complementing, will be described. The printing section included in the serial printer repeats main scanning in which the head 61 and the object to be printed M1 are relatively moved in the main scanning direction D2, relatively moves the head 61 and the object to be printed M1 between one and the other of the main scanning in the sub scanning direction D3, and forms the dots DT of the raster RA toward the main scanning direction D2 as M-th pass. In the printing apparatus 1 of a specific example, the head 61 is moved in the main scanning direction D2 without moving the object to be printed M1 at the time of performing main scanning, and the object to be printed M1 is moved in the sub scanning direction D3 at the time of performing sub scanning. Of course, this technology can be adopted to the printing apparatus in which the object to be printed is moved in the main scanning direction at the time of performing main scanning, and also the printing apparatus in which the object to be printed is moved in the sub scanning direction at the time of performing sub scanning.

Moreover, as the printing apparatus to which the technology can be adopted, copy machines, facsimiles, complex machines having functions of these machines, and the like may be used. As ink used for an ink jet printer which forms color images, for example, C (cyan) ink, M (magenta) ink, Y (yellow) ink, and K (black) ink are used. Of course, as the ink, further, Or (orange), Gr (green), and uncolored ink for improving the image quality, and the like may be used.

FIG. 2 schematically illustrates that dots are formed on which raster using which nozzle at the time of bidirectional printing of three-pass. For the sake of clear description, in the same manner in FIG. 6, and the like, twelve nozzles 64 are arranged on a nozzle row 68 of the recording head 61 in the arrangement direction D1, each of the nozzles is given numerals of 1-st to 12-th, and the nozzles are fed for every passes as four nozzles, the circled numbers of the circle 1 to the circle 3 indicate each of passes. A use of such a head 61 is included in the technology; however, in actuality, for example, a head which is provided with the nozzle row including the nozzle equal to or more than 100 is frequently used. Moreover, the symbol D2 indicates the main scanning direction orthogonal (perpendicular) to the arrangement direction D1, the symbol D3 indicates the sub scanning direction orthogonal (perpendicular) to the main scanning direction D2, the symbol D4 indicates the width direction of the object to be printed M1, the symbol RA indicates the raster along the main scanning direction D2, and the symbol PX indicates the pixel. In FIG. 2, the arrangement direction D1 and the sub scanning direction D3 are same as each other; however, the directions different from each other are also included in the technology. In addition, the main scanning direction D2 and the width direction D4 are same as each other; however, the directions different from each other are also included in the technology. Further, the directions D1 and D3 are orthogonal to the directions D2 and D4, and the directions are included in the technology even when the directions are not orthogonal to each other if it are different from each other.

The head 61 as illustrated in FIG. 1 includes the nozzles 64 of C (cyan) ink, M (magenta) ink, Y (yellow) ink, and K (black) ink. In FIG. 2, the plurality of nozzles 64 which discharge ink droplets of one color of the CMYK ink are arranged in a predetermined arrangement direction D1 so that the nozzle row 68 are configured. Moreover, a nozzle row in which the nozzles are disposed in zigzag is also included in the technology. The arrangement direction in this case means a direction where the nozzles are arranged in zigzag.

When the 3-rd nozzle as illustrated in FIG. 2 are the defective nozzle LN, a missing dot pixel PXL in which a dot is not formed is formed on an ink droplet landed position from the 3-rd nozzle. In FIG. 2, an X symbol is given to the defective nozzle, and an X symbol is also given to the corresponding the missing dot pixel PXL. When the defective nozzle LN is detected, the complementary dot DT10 is formed using the complementary nozzles RN in the block B. As the complementary dot DT10, there are the complementary dot DT11 being formed on a missing raster (first raster) RA1 to be recorded using the defective nozzle LN and the complementary dot DT12 being formed on complementary rasters (second raster) RA2*a* and RA2*b* in both sides of the missing raster RA1. Here, the complementary rasters RA2*a* and RA2*b* are collectively referred to as the complementary raster RA2. A nozzle which is used for forming the complementary dot DT11 in the block B is the 11-th nozzle of the pass 1, and the 7-th nozzle of the pass 2. The 11-th and 7-th nozzles are the first raster complementary nozzle RN1 of the technology. A nozzle which is used for forming the complementary dot DT12 on the complementary raster RA2*a* in the block B is the 10-th nozzle of the pass 1, the 6-th nozzle of the pass 2, and the 2-nd nozzle of the pass 3. These 10-th, 6-th, and 2-nd nozzles are the second raster complementary nozzle RN2 of the technology. A nozzle which is used for forming the complementary dot DT12 on the complementary raster RA2*b* in the block B is the 12-th nozzle of the pass 1, the 8-th nozzle of the pass 2, and the 4-th nozzle of the pass 3. These 12-th, 8-th, and 4-th nozzles are the second raster complementary nozzle RN2 of the technology. Here, the complementary nozzles RN1 and RN2 are collectively referred to as the complementary nozzle RN.

Moreover, the technology also includes that the complementary dot for complementing a dot to be formed using the 3-rd nozzle of the pass 3 is formed on secondary vicinity rasters RA2*c* and RA2*d* adjacent to an opposite side of the missing raster RA1 from the complementary rasters RA2*a* and RA2*b*, or the like.

The printing apparatus 1 as illustrated in FIG. 1 is provided with a controller 10, a random access memory (RAM) 20, a non-volatile memory 30, a defective nozzle detecting unit 70, a mechanism section 50, interfaces (I/F) 71 and 72, an operation panel 73, and the like. The controller 10, the RAM 20, the non-volatile memory 30, the I/F 71 and 72, and the operation panel 73 are connected through a path 80 so as to be capable of inputting and outputting information to each other.

The controller 10 is provided with a central processing unit (CPU) 11, a resolution conversion section 41, a color conversion section 42, a dot distribution section 43, a halftone processing section 44, a driving signal transmission section 46, and the like. The controller 10 constitutes the complementing section U2 including the adjusting section U3, and constitutes the defective nozzle detecting section U1 with the defective nozzle detecting unit 70. The controller 10 can be constituted by a system-on-a-Chip (SoC), and the like.

The CPU 11 is a device which mainly performs information processing or controlling in the printing apparatus 1.

The resolution conversion section 41 converts a resolution of an input image from a host device H1, a memory card 90, or the like into a setting resolution. The input image is realized by, for example, RGB data in which to each pixel includes an integer value of 256 gradation of RGB (red, green, and blue).

The color conversion section 42 converts the RGB data of the setting resolution into the CMYK data including the integer value of the 256 gradation of the CMYK with reference to, for example, a color conversion lookup table (LUT) in which a corresponding relationship of each gradation value of the RGB and each gradation value of the CMYK is regulated. The CMYK data of the 256 gradation indicates a used amount of the ink 66 in each the pixel.

Figure 3:
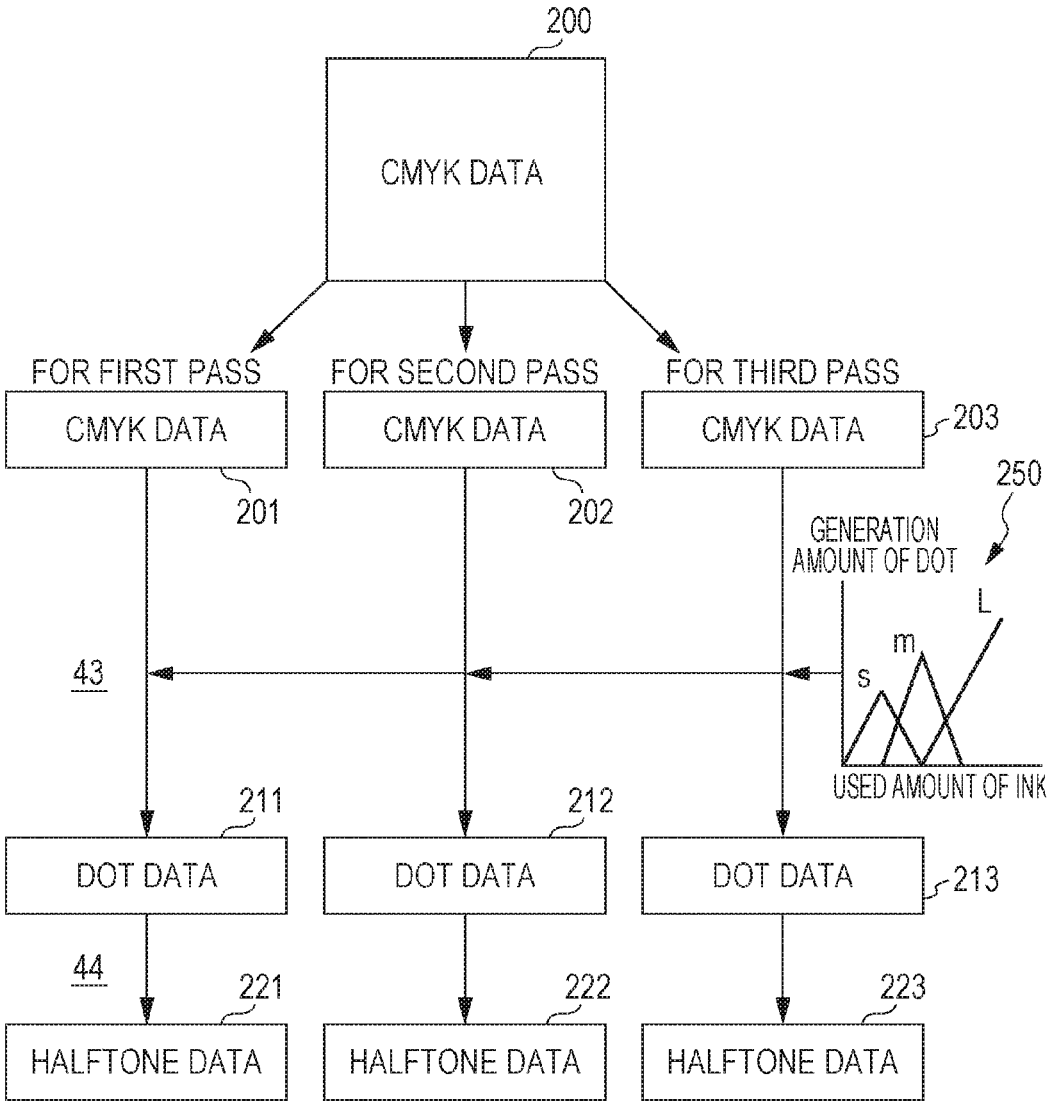
FIG. 3 is a diagram schematically illustrating an example in which halftone data is generated using CMYK data.
Figure 9:
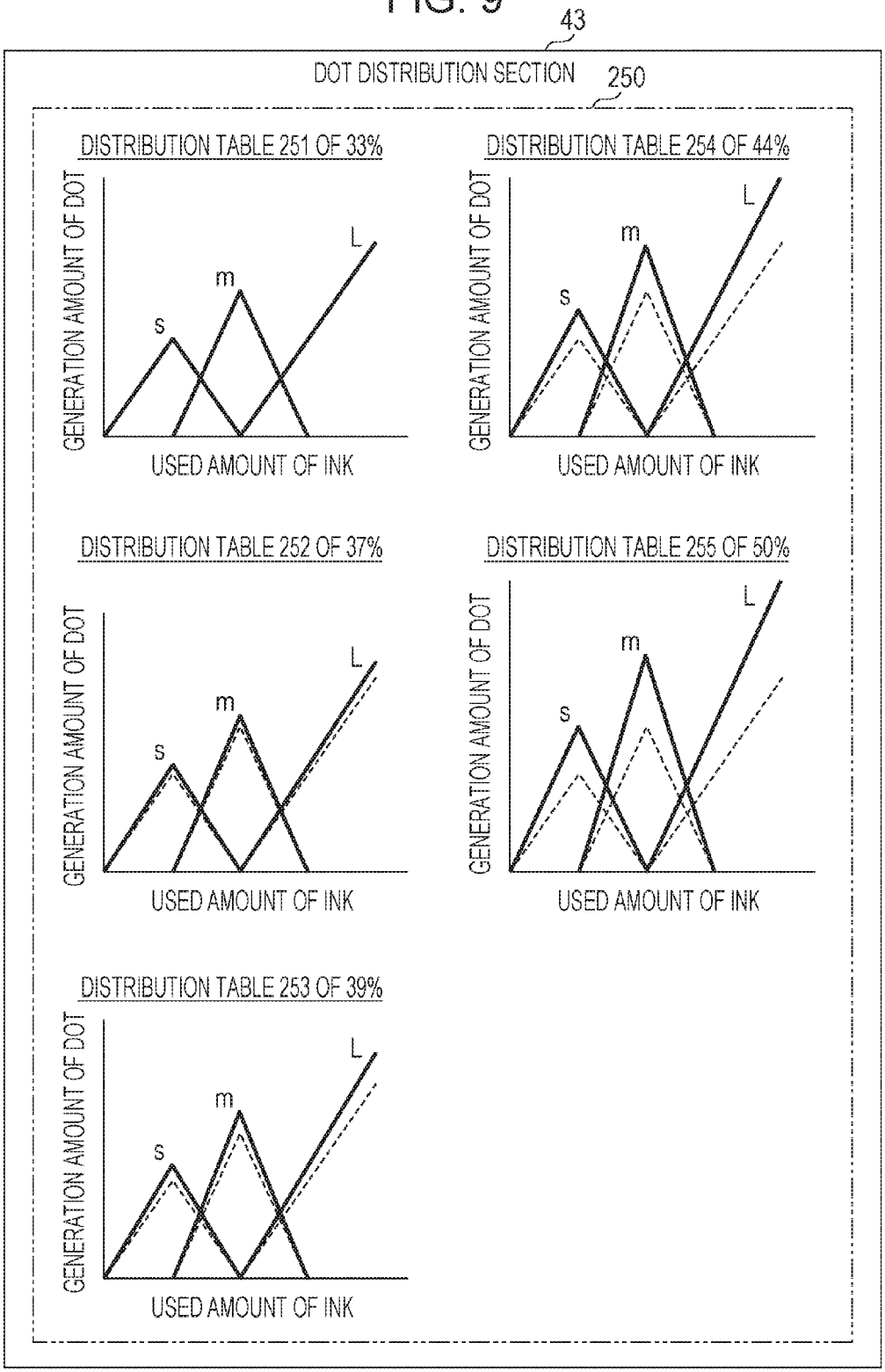
FIG. 9 is a diagram schematically illustrating an example of a distribution table for changing the usage rate of ink.

With reference to the distribution table 250 as illustrated in FIG. 3, the dot distribution section 43 converts, for example, the CMYK data of the 256 gradation into dot data 211 to 213 which indicates a generated amount (disclosed as dot generated amount) of a small dot (s), a middle dot (m), and a large dot (L). The distribution table 250 is a lookup table in which a corresponding relationship of a used amount of the ink 66 and a generated amount of a small dot, a middle dot, and a large dot is regulated. As illustrated in FIG. 3, the dot distribution section 43 of the specific example distributes a primary CMYK data 200 to the CMYK data 201, 202, and 203 in each pass, and generates the dot data 211, 212, and 213 in each pass. Since the CMYK data 200 is uniformly distributed, when the dot complementing is not performed, the usage rate of the ink 66 is divided into ⅓, and the distribution table 251 corresponding to substantially 33% ink the usage rate is used as illustrated in FIG. 9. It will be described in detail later, when the dot complementing is performed, the dot distribution section 43 generates the dot data 211 to 213 with reference to the distribution tables 251 to 255 corresponding to the usage rate of the ink 66.

The halftone processing section 44 performs a predetermined halftone process, for example, a dither method, an error diffusion method, or density pattern method, with respect to a gradation value of each pixel constituting the dot data 211 to 213, and reduce the number of gradation of the gradation value, so that the halftone data 221 to 223 are generated. The halftone data is data indicating a circumstance of a dot formation and multi-value data of three gradations or more capable of corresponding to a dot having different size, such as each dot of small, middle, or large size in the specific; however, it may be data of two gradations indicating presence or absence of the dot formation. As four values data indicated by two bits regarding each pixel, for example, data can be used in which 3 corresponds to a large dot formation, 2 corresponds to a middle dot formation, 1 corresponds to a small formation, 0 corresponds to a non-dot formation. The halftone processing section 44 of the specific example converts the dot data 211, 212, and 213 in each pass into the halftone data 221, 222, and 223.

The driving signal transmission section 46 generates nozzle data (referred to as raster data) by rearranging the halftone data 221 to 223 in a dot formation order, and generates a driving signal SG corresponding to a voltage signal applied to a driving element 63 of the head 61 from the nozzle data so as to output a resultant to a driving circuit 62. For example, the driving signal transmission section outputs a driving signal which makes ink droplets for forming a large dot discharged when the halftone data 221 to 223 indicate the "large dot formation", outputs a driving signal which makes ink droplets for forming a middle dot discharged when the halftone data 221 to 223 indicate the "middle dot formation", and outputs a driving signal which makes ink droplets for forming a small dot discharged when the halftone data 221 to 223 indicate the "small dot formation".

Each of sections 41 to 43, 45, and 46 may be configured using an application specific integrated circuit (ASIC), and may directly read data of an object to be processed from the RAM 20, or may directly write data after processing on the RAM 20.

It will be described in detail later, the complementing section U2 of the specific example is mounted in the dot distribution section 43.

The mechanism section 50 which is controlled by the controller 10 is provided with a carriage motor 51, a paper feeding mechanism 53, a carriage 60, a head 61, and the like. The carriage motor 51 reciprocates a carriage 60 in the main scanning direction D2 through a plurality of gears, which are not illustrated, and a belt 52. The paper feeding mechanism 53 transports the object to be printed M1 in the sub scanning direction D3. In the carriage 60, for example, the head 61 which discharges the ink droplets 67 of the CMYK is mounted. The head 61 is provided with the driving circuit 62, the driving element 63, and the like. The driving circuit 62 applies a voltage signal to the driving element 63 according to the driving signal SG input from the controller 10. In the driving element 63, a piezoelectric element for applying a voltage to the ink (liquid) 66 in a pressure chamber communicating with the nozzle 64, a driving element for discharging the ink droplets 67 from the nozzle 64 by generating bubbles in the pressure chamber using heat, and the like can be used. In the pressure chamber of the head 61, the ink 66 is supplied from the ink cartridge (liquid cartridge) 65. A combination of the ink cartridge 65 and the head 61, for example, is formed on each of the CMYK. The ink 66 in the pressure chamber is discharged as the ink droplets 67 toward the object to be printed M1 from the nozzle 64 by the driving element 63, and the dots DT of the ink droplets 67 are formed on the object to be printed M1 such as a printing sheet. The head 61 is moved in the main scanning direction D2, that is, a plurality of the nozzles 64 and the object to be printed M1 are reciprocated in the main scanning direction D2, and a dot corresponding to a dot size indicated by the halftone data is formed, and thus a printed image IM1 is formed on the object to be printed M1.

The RAM 20 is a non-volatile semiconductor memory having a large capacitance. A program PRG2 including a program, which makes the defective nozzle detecting function and complementing function corresponding to each of sections U1 and U2 of the printing control apparatus U0 realized in the printing apparatus 1, and the like are stored in the RAM 20.

In the non-volatile memory 30, program data PRG1, or the like developed in the RAM 20 are stored. In the non-volatile memory 30, a read only memory (ROM), a magnetic recording medium such as a hard disk, or the like is used. Moreover, developing of the program data PRG1 means writing the data as the program PRG2 which can be read by the CPU 11 in the RAM 20.

A card I/F 71 is a circuit for writing data in the memory card 90 or reading the data from the memory card 90.

A communication I/F 72 is connected to the host device H1, and inputs and outputs information to and from the host device H1. As the host device H1, a computer such as a personal computer, a digital camera, a digital video camera, a mobile phone such as a smart, and the like are used.

The operation panel 73 includes an outputting section 74, an inputting section 75, and the like, and a user can input various instructions with respect to the printing apparatus 1. The outputting section 74 is configured to have, for example, a liquid crystal panel (display section) which displays information corresponding to various instructions or a state of the printing apparatus 1. The outputting section 74 may output the information as sound. The inputting section 75 is configured to have an operation key, for example, a cursor key or an enter key (operation inputting section). The inputting section 75 may be a touch panel, or the like received an operation of a display screen.

The defective nozzle detecting unit 70 is configured to have the defective nozzle detecting section U1 with the controller 10 which detects whiter or not a state of each of the nozzles 64 is normal or defected.

Figure 4A:
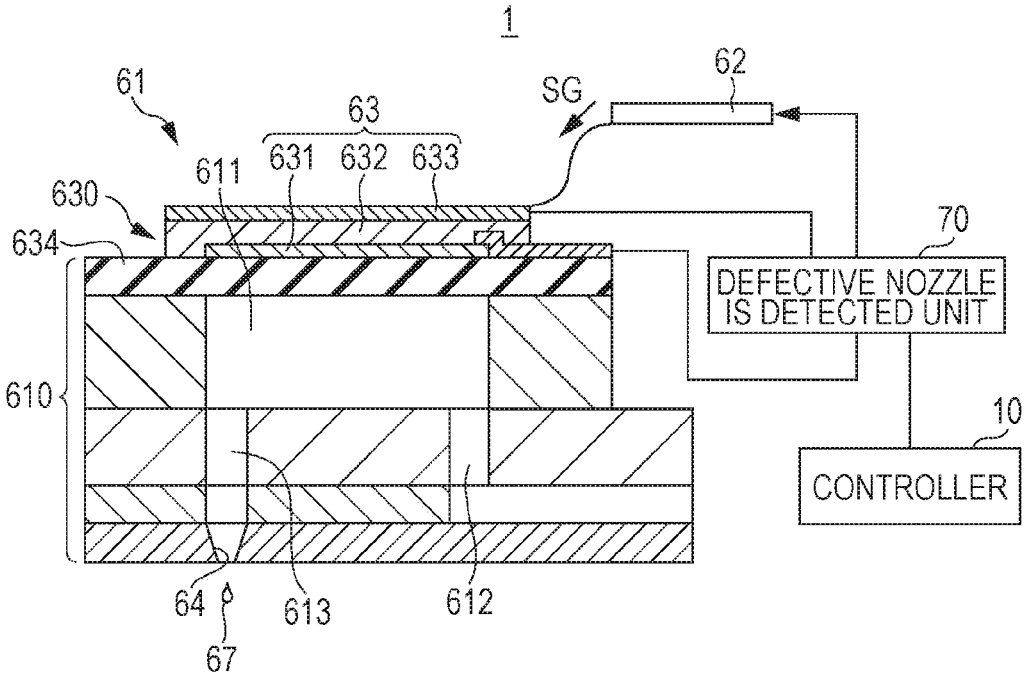
FIG. 4A is a diagram schematically exemplifying a main part of the printing apparatus.
Figure 4B:
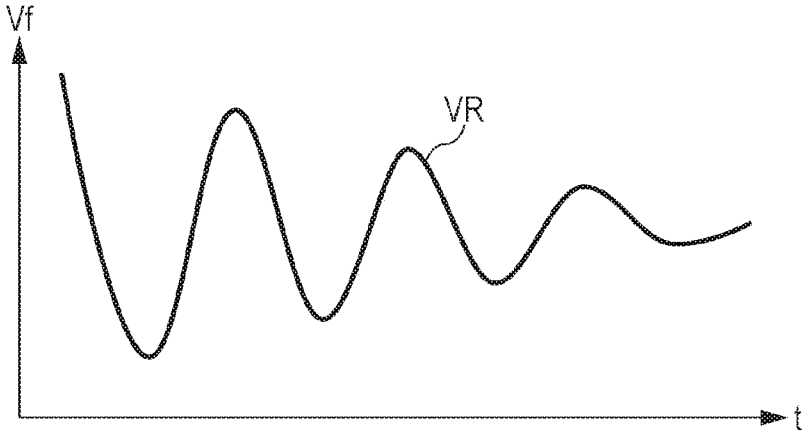
FIG. 4B is a diagram schematically illustrating an example of an electromotive force curved line based on residual vibration of a vibrating plate.
Figure 5A:
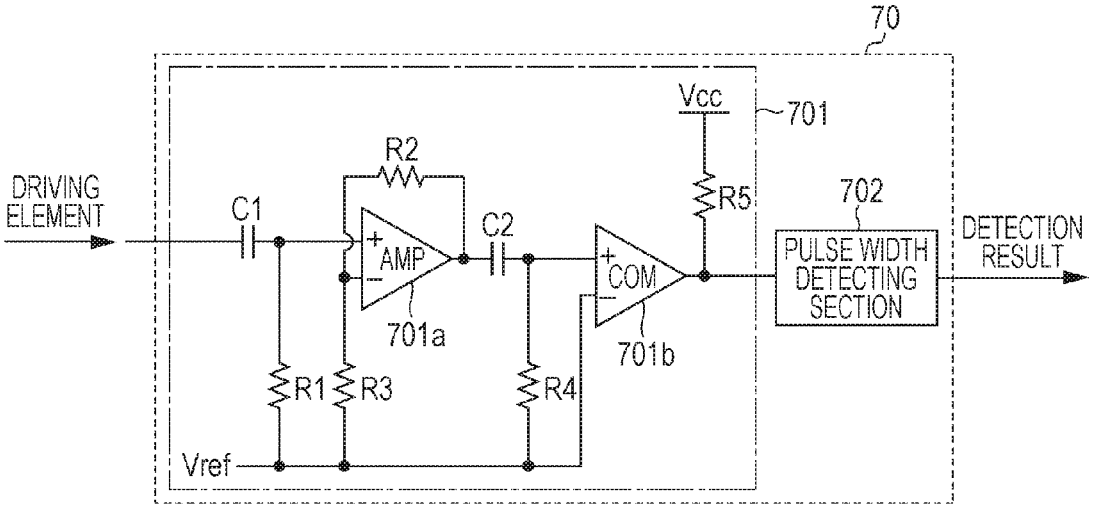
FIG. 5A is a diagram illustrating an example of an electrical circuit of a detecting unit that detects a defective nozzle.
Figure 5B:
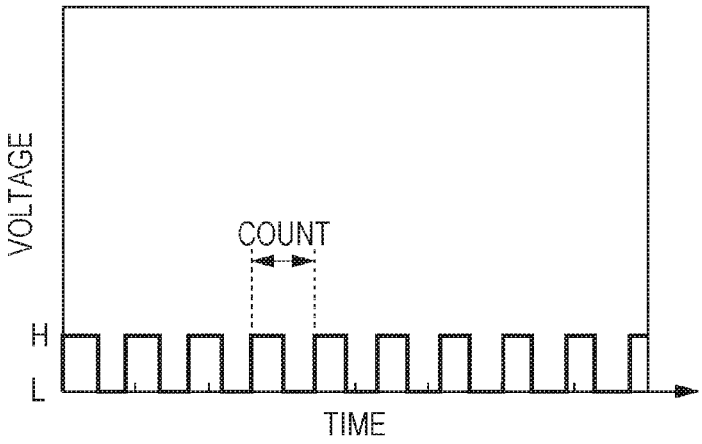
FIG. 5B is a diagram schematically illustrating an example of an output signal from an amplifier.

FIGS. 4A and 4B are diagrams for describing an example of a method of detecting a state of the nozzles 64, and FIG. 4A schematically illustrates a main part of the printing apparatus 1, and FIG. 4B schematically illustrates an electromotive force curved line VR based on the residual vibration of the vibrating plate 630. FIG. 5A illustrates an example of the electrical circuit of the detecting unit 70, and FIG. 5B schematically illustrates an example of an output signal from a comparator 701*b*.

In the flow path substrate 610 of the head 61 illustrated in FIG. 4A, a pressure chamber 611, an ink supplying path 612 in which the ink 66 flows from an ink cartridge 65 to a pressure chamber 611, a nozzle communicating path 613 in which the ink 66 flows from the pressure chamber 611 to the nozzle 64, and the like are formed. As the flow path substrate 610, for example, silicon substrate, or the like can be used. A surface of the flow path substrate 610 is formed of a vibrating plate section 634 which constitutes a part of a wall of the pressure chamber 611. The vibrating plate section 634 can be made of, for example, silicon oxide, or the like. The vibrating plate 630 is configured to have, for example, the vibrating plate section 634, the driving element 63 formed on the vibrating plate section 634, and the like. The driving element 63 can be formed of, for example, a piezoelectric element, or the like which includes a lower electrode 631 formed on the vibrating plate section 634, a piezoelectric layer 632 formed on the general lower electrode 631, an upper electrode 633 formed on the general piezoelectric layer 632. As the electrodes 631 and 633, for example, platinum, gold, or the like can be used. As the piezoelectric layer 632, for example, a perovskite type oxide material of a ferroelectric, such as lead zirconate titanate (PZT, $Pb(Zr_x, Ti_{1-x})O_3$ in a stoichiometric ratio) can be used.

FIG. 4A is a block diagram illustrating a main part of the printing apparatus 1 which is provided with the detecting unit 70 detecting an electromotive force state from the piezoelectric element (driving element 63) based on the residual vibration of the vibrating plate 630. A one end of the detecting unit 70 is electrically connected to the lower electrode 631, and the other end of the detecting unit 70 is electrically connected to a upper electrode 633.

FIG. 4B exemplifies the electromotive force curved line (electromotive force state) VR of the driving element 63 based on the residual vibration of the vibrating plate 630 generated after supplying the driving signal SG for discharging the ink droplets 67 from the nozzle 64. Here, a horizontal axis indicates a time t, and the vertical axis indicates an electromotive force Vf. The electromotive force curved line VR indicates an example in which the ink droplets 67 are discharged from a normal nozzle 64. When the ink droplets 67 are not discharged from the nozzle or a trace of the discharged ink droplets 67 is not correctly drawn due to clogging or the like, the electromotive force curved line is deviated from the VR. Here, using a detecting circuit as illustrated in FIG. 5A it is possible to detect whether or not the nozzle 64 is normal or defected.

The detecting unit 70 as illustrated in FIG. 5A is provided with an amplifier 701 and a pulse width detecting section the pulse width detecting section 702. The amplifier 701 includes, for example, an amplifier 701*a*, the comparator 701*b*, capacitors C1 and C2, and resistances R1 to R5. When the driving signal SG output from the driving circuit 62 is applied to the driving element 63, the residual vibration is generated, and the electromotive force is input to the amplifier 701 based on the residual vibration. A low frequency component of the electromotive force is removed by a high-pass filter constituted by the capacitor C1 and the resistance R1, the electromotive force after removing the low frequency component is amplified by the amplifier 701*a* with a predetermined amplification factor. Outputting of the amplifier 701*a* passes through the high-pass filter constituted by the capacitor C2 and the resistance R4, is compared with a reference voltage Vref using the comparator 701*b*, and is converted into a pulse-like voltage of a high level H or a low level L based on whether or not it is higher than the reference voltage Vref.

FIG. 5B illustrates an example of a pulse-like voltage which is output from the comparator 701*b* and input to the pulse width detecting section 702. The pulse width detecting section 702 resets a count value at the time of rising the pulse-like voltage being input, increases the count value in every predetermined periods, and outputs the count value at the time of rising a next pulse-like voltage to the controller 10 as a detected result. The count value corresponds to a circle of the electromotive force based on the residual vibration, and the count value which is sequentially output indicates frequency characteristics of the electromotive force based on the residual vibration. The frequency characteristics (for example, circle) of the electromotive force when the nozzle is the defective nozzle LN is different from the frequency characteristics of the electromotive force when the nozzle is normal. Here, the controller 10 can determine that the nozzle, which is an object to be detected, is normal when the count value which is sequentially input is within an allowable range, and can determine that the nozzle, which is an object to be detected, is the defective nozzle LN when the count value which is sequentially input is not in an allowable range.

Processes described above are performed on each of the nozzles 64, the controller 10 can recognize a state of each of the nozzles 64. In the specific example, when a process of detecting the defective nozzle LN is performed during repeatedly performing main scanning, if the defective nozzle LN is detected, the usage rate of ink discharged from the same complementary nozzles RN from subsequent main scanning to the M−1-th main scanning is increased.

3. Specific Example of Dot Complementing of Multipath Printing

Next, bidirectional printing of the multipath of M=3 as illustrated in FIG. 6 will be described in detail. In the pass 1, substantially ⅓ of the pixels PX of the printing regions AP11 to AP13 become a formation object of the dot DT. That is, the usage rate of ink for forming a dot of the raster RA of the printing regions AP11 to AP13 is set to substantially 33%. In the pass 2, substantially ⅓ of the pixels PX of the printing regions AP12 to AP14 become a formation object of the dot DT. In the pass 3, substantially ⅓ of the pixels PX of the printing regions AP13 to AP15 become a formation object of the dot DT. Therefore, a formation of dots of the printing region AP13 when the pass 3 is terminated is complete. Here, with respect to the printing region AP13, the 1-st to 4-th nozzles which are used for forming dots on the initial pass 1 are referred to as a first group G1, the 5-th to 8-th nozzles which are used for forming dots on the next pass 2 are referred to as a second group G2, and the 9-th to 12-th nozzles which are used for forming dots on the last pass 3 are referred to as a third group G3. In the pass 4, substantially ⅓ of the pixel PX of the printing regions AP14 to AP16 become a formation object of the dot DT. Therefore, a dot formation of the printing region AP14 when the pass 4 is terminated is complete. Also, in the printing region AP14, the 1-st to 4-th nozzles of the first group G1 of the initial pass 2 are used, the 5-th to 8-th nozzles of the second group G2 of the next pass 3 are used, and the 9-th to 12-th nozzles of the third group G3 of the last pass 4 are used. Also, even in after the pass 5, a process will be performed same as the above. In each of the passes, the usage rate of ink for forming dots of the raster RA of the object is substantially 33%.

For the sake of clear description, it assumes that the printed image IM1 is formed according to the halftone data 221 to 223 which make middle size dots be formed on all of the pixels. In this case, middle dots are formed on substantially ⅓ of the pixels PX of the printing regions AP11 to AP13 in the pass 1, middle dots are formed on substantially ⅓ of the pixels PX of the printing regions AP12 to AP14 in the pass 2, and middle dots are formed on substantially ⅓ of the pixels PX of the printing regions AP13 to AP15 in the pass 3. Therefore, middle dots are formed on all of the pixels of the printing region AP13 when the pass 3 is terminated. When the dots are landed onto the printing region AP13, the dots DT are formed using the ink droplets 67 from the 9-th to 12-th nozzles of the pass 1, the 5-th to 8-th nozzles of the pass 2, and the 1-st to 4-th nozzles of the pass 3. Here, dots of the raster RA31 are formed using the 9-th, 5-th, and 1-st nozzles, dots of the raster RA32 are formed using the 10-th, 6-th, and 2-nd nozzles, dots of the raster RA33 are formed using 11-th, 7-th, and 3-rd nozzles, and dots of the raster RA34 are formed using 12-th, 8-th, and 4-th nozzles. Also, even in the printing region AP14, a process will be performed same as the above.

Figure 7:
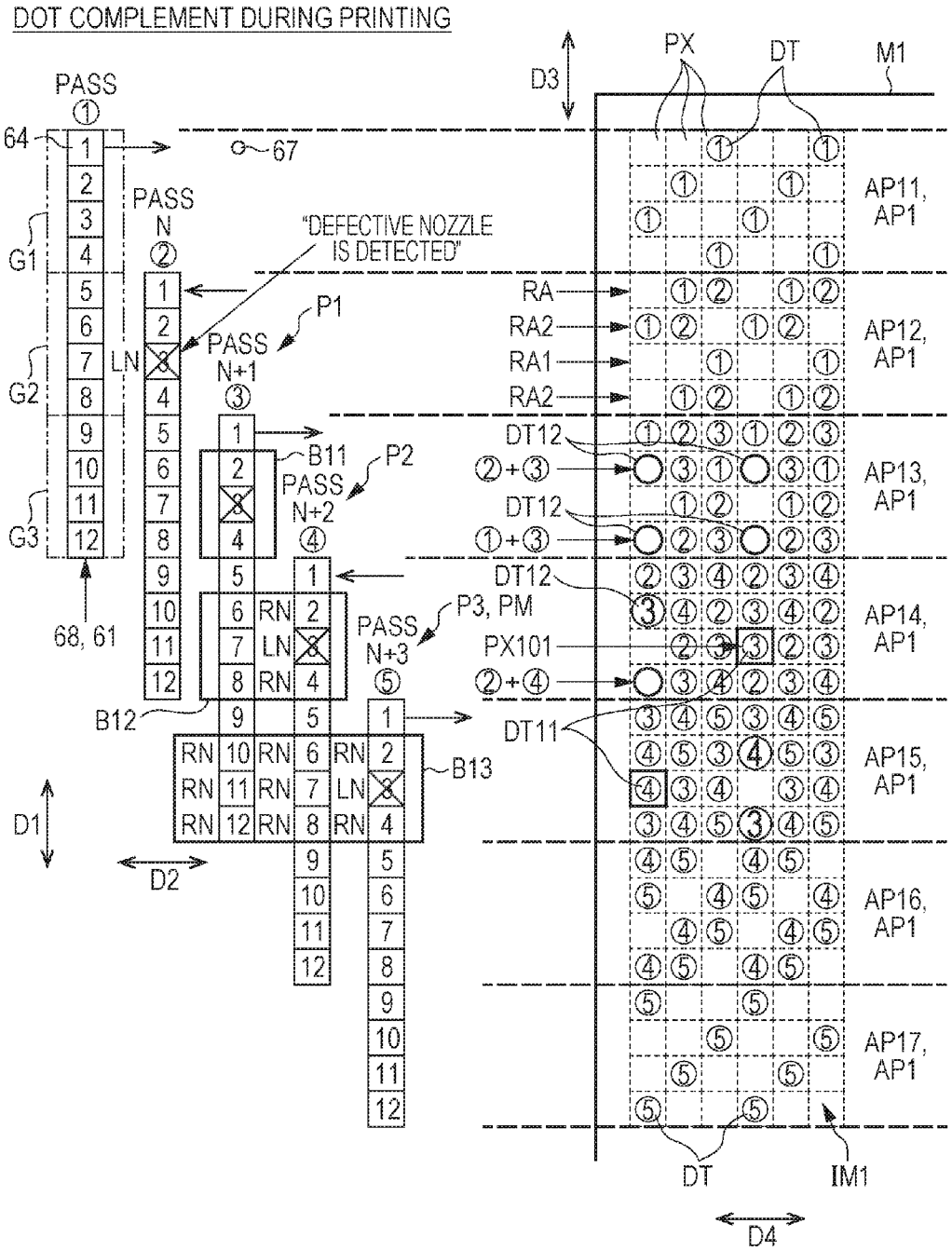
FIG. 7 is a diagram schematically illustrating an example of dot complementing when detecting that a third nozzle is a defective nozzle during printing.

Therefore, for example, when the 3-rd nozzle of the first group G1 becomes the defective nozzle LN, like the block B13 as illustrated in FIG. 7, there is a possibility that dots of the missing raster RA1 to be recorded using the 3-rd nozzle can be complemented using the 11-th and 7-th nozzles (first raster complementary nozzle RN1) which is used for forming dots in the same missing raster RA1. Performing of the dot complementing using only the 11-th and 7-th nozzles is included in the technology; however, when an error is generated in paper feeding, a thin line is shown the missing raster RA1 during the dot complementing using only the 11-th and 7-th nozzles. Here, the second raster complementary nozzle RN2 which is used for forming dots on the complementary raster RA2 in a vincinity of the missing raster RA1, specifically, the 10-th, 6-th, and 2-nd nozzles which is used for forming dots on the complementary raster RA2*a*, and the 12-th, 8-th, and 4-th nozzles which is used for forming dots on the complementary raster RA2*b* are also used for the dot complementing. Moreover, in FIG. 7, an X symbol is given to the defective nozzle LN, the complementary dot DT11 of the first raster RA1 is illustrated to be surrounded by thick lines of a square shape, and the complementary dot DT12 (for example, large dot) in which a size thereof is increased is illustrated by a larger circle number, and the complementary dot DT12 (for example, large dot) in which the ink droplets using the plurality of nozzles are overlapped with each other and formed is illustrated by the circle symbol.

However, as illustrated in FIG. 7, when the defective nozzle LN is generated during printing (for example, pass 2), a part of the complementary nozzles RN cannot be used in the first main scanning P1 (for example, pass 3) which is sequentially performed after the defective nozzle LN is detected, and the second main scanning P2 (for example, pass 4) next to the first main scanning P1. For example, the 5-th to 12-th nozzles used in the passes 1 and 2 cannot be used in the dot complementing with respect to the 3-rd nozzle of the pass 3 (first main scanning P1). All complementary nozzles RN inside the block B13 can be used in the dot complementing with respect to the 3-rd nozzle of the pass 5 (M-th main scanning PM). Here, regarding the usage rate of the ink 66 discharged using the same complementary nozzle RN, the usage rate of the ink 66 from the first main scanning P1 to the M−1-th main scanning (for example, second main scanning P2) is adjusted to be greater than the usage rate of the ink 66 in the M-th main scanning PM.

FIG. 8 schematically illustrates a distribution ratio of the used amount of the ink 66 for forming the complementary dot DT10, and, an example of the usage rate of the ink 66 after the distribution. In right side of FIG. 8, a ratio of distributing the used amount of the ink to be discharged using the defective nozzle LN to the maximum eight complementary nozzles RN inside the blocks B11 to B13 is illustrated, and in a lower side thereof, the usage rate in which a usage rate corresponding to the distribution ratio is added to substantially 33% of the original ink the usage rate is illustrated by parentheses. In the example, substantially 33% of the usage rate of ink to be discharged using the 3-rd nozzle which is the defective nozzle LN is distributed to the maximum eight complementary nozzles RN inside the blocks B11 to B13. When the distribution ratios with respect to the complementary nozzles RN inside the blocks B11 to B13 are summed into 1. Here, when the first raster complementary nozzle RN1 is used, the distribution ratio with respect to the first complementary nozzle RN1 is set to be greater than the distribution ratio with respect to the second raster complementary nozzle RN2. Moreover, the distribution ratio and the usage rate illustrated in the specific example are only examples for being easily illustrated, and can be suitably transformed.

When the 3-rd nozzle is detected to be the defective nozzle LN before printing, the distribution ratio with respect to the complementary nozzles RN is a distribution ratio illustrated in the block B13. In the block B13, the distribution ratios with respect to the 11-th and 7-th nozzles which are the first raster complementary nozzle RN1 is set to 1/6, and the distribution ratios of the 10-th, 6-th, 2-nd, 12-th, 8-th, and 4-th nozzles which are the second raster complementary nozzle RN2 is set to 1/9.

Here, as illustrated in FIG. 7 and FIG. 8, the 3-rd nozzle becomes the defective nozzle LN during the pass N=2. When a formation of dots of the printing region AP13 on the pass 3 (first main scanning P1) which is performed after the defective nozzle LN is detected is terminated, the 5-th to 12-th nozzles which are already used cannot be used in the dot complementing. Here, the dot complementing is performed in the printing region AP13, inside the second raster complementary nozzle RN2, the 2-nd and 4-th nozzles in the block B11 in the pass 3 are used. As illustrated in FIG. 8, the distribution ratio of the used amount of the ink 66 for forming the complementary dot DT10 is set to be ½ same as the 2-nd and 4-th nozzles. For this reason, the ink usage rate of the 2-nd and 4-th nozzles is 33% x {1+(½)≈}substantially 50%. In FIG. 7, the complementary dot DT12 (for example, large dot), in which the ink droplets of the 2-nd nozzle of the pass 3 are added to the ink droplets from the 6-th nozzle of the pass 2, is formed on the second raster RA2, and the complementary dot DT12 (for example, large dot), in which the ink droplets from the 4-th nozzle of the pass 3 is added to the ink droplets from the 12-th nozzles of the pass 1, is formed on the second raster RA2. Accordingly, when the dots become large, the ink usage rate of the second raster complementary nozzle RN2 in the first main scanning P1 increases.

When a dot formation of the printing region AP14 is complete in the pass 4 (second main scanning P2) next to the pass 3, the 9-th to 12-th nozzles used in the pass 2 cannot be used for the dot complementing. Here, when the dot complementing in the printing region AP14 is performed, inside the complementary nozzle RN, the 7-th nozzle (first raster complementary nozzle RN1) inside the block B12 in the passes 3 and 4, and the 6-th, 2-nd, 8-th, and 4-th nozzles (second raster complementary nozzle RN2) are used. As illustrated in FIG. 8, the distribution ratio of the used amount of the ink 66 for forming the complementary dot DT10, the 7-th nozzle which is the first raster complementary nozzle RN1 is ⅓, and the 6-th, 2-nd, 8-th, and 4-th nozzles which are the second raster complementary nozzle RN2 are 1/6. For this reason, the ink usage rate of the 7-th nozzle is 33%×{1+(⅓)}substantially 44%, and the ink usage rate of the 6-th, 2-nd, 8-th, and 4-th nozzles is 33%×{1+(1/6)}≈substantially 39%. In FIG. 7, the complementary dot DT11, which is formed using the 7-th nozzle in the pass 3 with respect to the pixel PX101 of the first raster RA1, is illustrated. As the number of dots per a unit area increase, the ink usage rate of the first raster complementary nozzle RN1 in the first main scanning P1 increases. In addition, it is described that the complementary dot DT12 which becomes great is formed on the second raster RA2 using the 6-th nozzle in the pass 3, and the complementary dot DT12, in which the ink droplets from the 4-th nozzle in the pass 4 is added to the ink droplets from the 12-th nozzles in the pass 2, is formed on the second raster RA2. Accordingly, when the dot becomes great, the ink usage rate of the second raster complementary nozzle RN2 in the first main scanning P1 and the second main scanning P2 increases.

When a dot formation of the printing region AP15 in the pass 5 (third main scanning P3) next to the pass 4 is complete, the 11-th and 7-th nozzles (first raster complementary nozzle RN1) in the passes 3 and 4, and the 10-th, 6-th, 2-nd, 12-th, 8-th, and 4-th nozzles (second raster complementary nozzle RN2) the passes 3, 4, and 5 are used. As illustrated in FIG. 8, as the distribution ratio of the used amount of the ink 66 for forming the complementary dot DT10, the 11-th and 7-th nozzles which are the first raster complementary nozzle RN1 are 1/6, and the 10-th, 6-th, 2-nd, 12-th, 8-th, and 4-th nozzles the second raster complementary nozzle RN2 are 1/9. For this reason, the ink usage rate of the 11-th and 7-th nozzles is 33%×{1+(⅙)}≤substantially 39%, and the ink usage rate of the 10-th, 6-th, 2-nd, 12-th, 8-th, 4-th nozzles is 33%×{1+(⅑)}substantially 37%. In FIG. 7, the complementary dot DT11 is formed using the 7-th nozzle in the pass 4 with respect to the first raster RA1. When the number of dots per a unit area is increased, the ink usage rate of the first raster complementary nozzle RN1 in the second main scanning P2 is increased. In addition, the complementary dot DT12 in which a size thereof is increased is formed on the second raster RA2 using the 6-th nozzle in the pass 4, and the complementary dot DT12 in which a size thereof is increased is formed on the second raster RA2 using the 12-th nozzles in the pass 3. When the dot is increased as described above, the ink usage rate of the second raster complementary nozzle RN2 in the first main scanning P1 and the second main scanning P2 are increased.

Moreover, the pass 5 is also the M-th main scanning PM, the dot complementing is formed at the distribution ratio (the ink usage rate) same as a case of detecting that the 3-rd nozzle is the defective nozzle LN before printing. In the pass after the pass 6, if the defective nozzle LN is not detected, the dot complementing is performed at the distribution ratio (the ink usage rate) same as that of the pass 5.

Here, with reference to FIG. 8, a change of the distribution ratio and the usage rate focusing on the complementary nozzles RN will be described. For example, the distribution ratio of the 2-nd nozzle is ½ of a time of the first main scanning P1 which is the pass N+1, is ⅙ of a time of the second main scanning P2 which is the pass N+M−1, is ⅙ of a time of the third main scanning P3 (M-th main scanning PM) which is the pass N+M ⅙, and is also ⅙ after the pass N+M+1. Therefore, the distribution ratio of the used amount of the ink 66 for forming the complementary dot DT10 is satisfied with expressions hereinbelow.

"Distribution ratio of first main scanning">"Distribution ratio of *M*-th main scanning" (1)

"Distribution ratio of first main scanning">"Distribution ratio of second main scanning" (2)

"Distribution ratio of second main scanning">"Distribution ratio of third main scanning" (3)

"Distribution ratio of *M*-th main scanning"="Distribution ratio of *M*+*m*−th scanning" (4)

However, m is an integer equal to or more than 1.

When changing the usage rate of the ink 66 after the distribution, the usage rate of the 2-nd nozzle is substantially 50% of a time of the first main scanning P1, is substantially 39% of a time of the second main scanning P2, is substantially 37% of a time of the third main scanning P3 (M-th main scanning PM), and is also substantially 37% after the pass N+M+1. Therefore, the usage rate of the ink 66 after the distribution is satisfied with expressions hereinafter.

"Ink usage rate of first main scanning">"Ink usage rate of *M*-th main scanning" (5)

"Ink usage rate of first main scanning">"Ink usage rate of second main scanning" (6)

"Ink usage rate of second main scanning">"Ink usage rate of third main scanning" (7)

"Ink usage rate of *M*-th main scanning"="Ink usage rate of *M*+*m*-th scanning" (8)

Even in the 6-th nozzle, the expressions are same.

Regarding the 6-th, 7-th, and 8-th nozzles used in the block B12, the above described expressions (1), (2), (4), (5), (6), and (8) are realized.

In order to realize the distribution ratio and the ink usage rate described above, for example, the distribution tables 251 to 255 illustrated in FIG. 9 can be used.

FIG. 9 schematically illustrates examples of the distribution tables 251 to 255 for changing the usage rate of the ink 66. The distribution table 251 of 33% is a distribution table for generating dot data allocated to the nozzle which does not perform the dot complementing, and corresponds to substantially 33% of the ink usage rate. The distribution table 252 of 37% is a distribution table for generating dot data allocated to the 10-th, 6-th, 2-nd, 12-th, 8-th, and 4-th nozzles in the block B13 illustrated in FIG. 8, and corresponds to the ink usage rate of substantially 37%. A generation amount of dots of the distribution table 252 of 37% is greater than a generation amount of dots of the distribution table 251 of 33% at an ink usage rate of substantially 37%/33%. The distribution table 253 of 39% is a distribution table for generating dot data allocated to the 6-th, 2-nd, 8-th, and 4-th nozzles in the block B12 and the 11-th and 7-th nozzles in the block B13 illustrated in FIG. 8, and corresponds to the ink usage rate of substantially 39%. A generation amount of dots of the distribution table 253 of 39% is greater than a generation amount of dots of the distribution table 251 of 33% at an ink usage rate of substantially 39%/33%. The distribution table 254 of 44% is a distribution table for generating dot data allocated to the 7-th nozzle in the block B12 illustrated in FIG. 8, and corresponds to the ink usage rate of substantially 44%. A generation amount of dots of the distribution table 254 of 44% is greater than a generation amount of dots of the distribution table 251 of 33% at the ink usage rate of substantially 44%/33%. The distribution table 255 of 50% is a distribution table for generating dot data allocated to the 2-nd and 4-th nozzles in the block B11 illustrated in FIG. 8, and corresponds to the ink usage rate of substantially 50%. A generation amount of dots of the distribution table 255 of 50% is greater than a generation amount of dots of the distribution table 251 of 33% at the ink usage rate of substantially 50%/33%.

In FIG. 8, for example, the dot data in which the CMYK data for the pass 3 is converted according to the distribution table 251 of 33% is allocated to the 1-st nozzle in the pass 3. The ink droplets are discharged from the 1-st nozzle according to the driving signal SG converted using the dot data, and the dots DT are formed at the ink usage rate of substantially 33%. With respect to the 2-nd nozzle of the pass 3 (first main scanning P1), the dot data in which the CMYK data for the pass 3 is converted according to the distribution table 255 of 50% is allocated thereto. The ink droplets are discharged from the 2-nd nozzle according to the driving signal SG converted using the dot data, and the dots DT including the complementary dot DT12 at the ink usage rate of substantially 50% are formed. With respect to the 7-th nozzle in the pass 3, the dot data in which the CMYK data for the pass 3 is converted according to the distribution table 254 of 44% is allocated thereto. The ink droplets discharged from the 7-th nozzle according to the driving signal SG converted using the dot data, and the dots DT including the complementary dot DT11 are formed at the ink usage rate of substantially 44%. It is the same as the other nozzles in the pass 3, and the passes after the pass 4 (second main scanning P2).

In the specific example, regarding the usage rate of ink discharged the same complementary nozzle RN, adjustments are performed as follows: the ink usage rate in the first main scanning P1 is greater than the ink usage rate in the M-th main scanning PM; the ink usage rate in the first main scanning P1 is greater than the ink usage rate in the second main scanning P2; and the ink usage rate in the second main scanning P2 is greater than the ink usage rate the third main scanning P3. Because of the adjustments, the dot complementing increases more than the M-th main scanning PM in the first main scanning P1, the dot complementing increases more than the second main scanning P2 in the first main scanning P1, the dot complementing increases more than the third main scanning P3 in the second main scanning P2, and insufficient of the dot complementing is suppressed. In addition, regarding the usage rate of ink discharged using the same complementary nozzle RN, the ink usage rate of main scanning performed after the M-th main scanning PM is constant, of the dot complementing in main scanning performed after the M-th main scanning PM are appropriately complemented. Therefore, the specific example, dots to be formed using the defective nozzle can be suitably complemented.

4. Specific Example in a Case in which Defective Nozzle is in Second Group

The technology can be used for a case in which dots to be formed using the defective nozzles LN which are in various positions are complemented.

Figure 10:
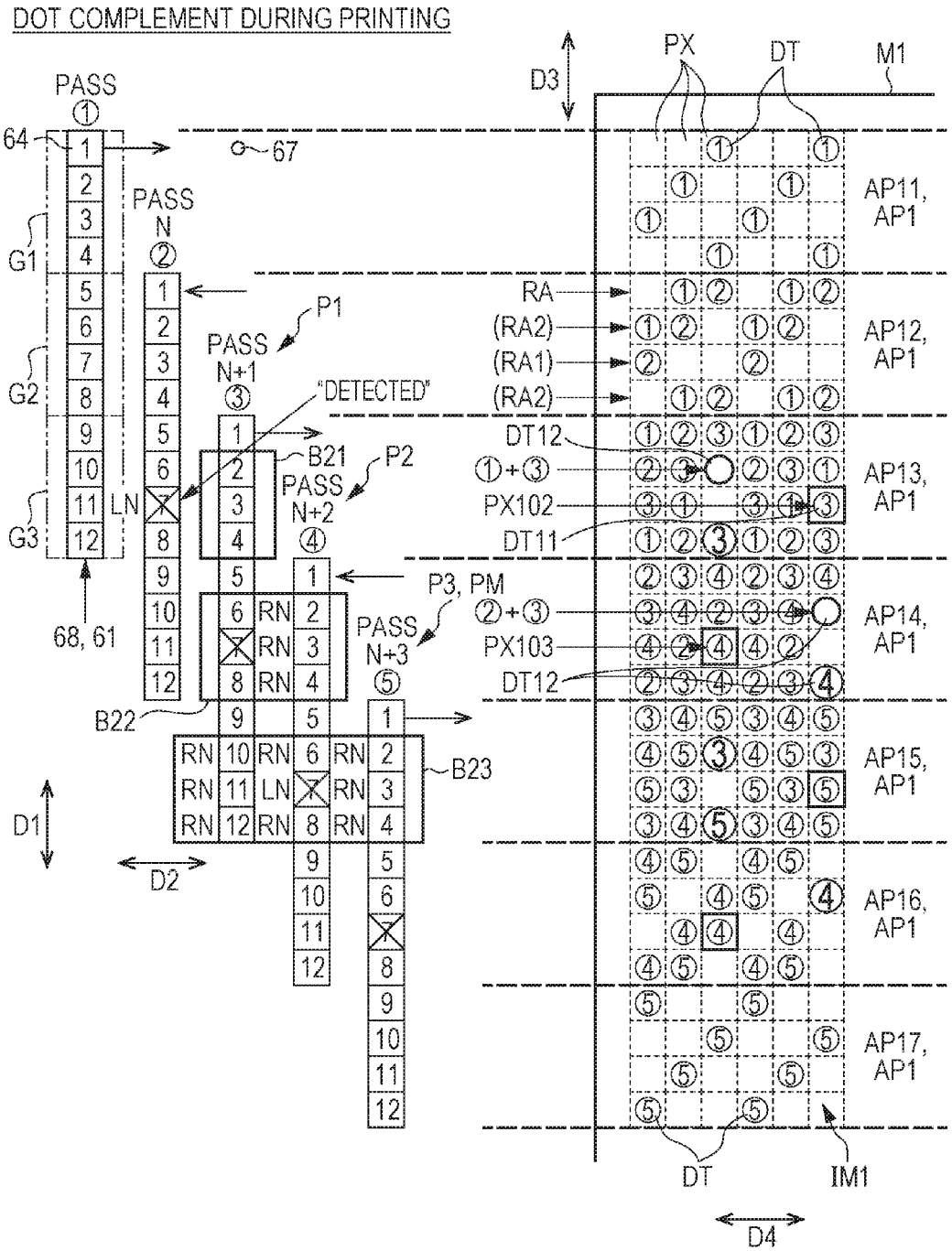
FIG. 10 is a diagram schematically illustrating an example of the distribution ratio of the used amount of ink for forming the complementary dot when detecting that a seventh nozzle is a defective nozzle during printing and the usage rate of ink after distribution.

FIG. 10 schematically illustrates an example in which the 7-th nozzle of the second group becomes the defective nozzle LN during printing (for example, pass 2). In this case, in the dot complementing with respect to the 7-th nozzle in the pass 2, the 1-st to 4-th nozzles in the pass 3 (first main scanning P1) can be used. However, the 5-th, 6-th, 8-th, and 12-th nozzles used for the passes 1 and 2 cannot be used for the dot complementing. In the dot complementing with respect to the 7-th nozzle in the pass 3, the 9-th to 12-th nozzles used for the pass 2 cannot be used. In the dot complementing with respect to the 7-th nozzle in the pass 4 (second main scanning P2), all of the complementary nozzles RN inside the block B23 in which all dots are formed due to the M-th main scanning PM can be used. Here, regarding the usage rate of the ink 66 discharged using the same complementary nozzle RN, an adjustment is performed so that the usage rate of the ink 66 from the first main scanning P1 to M−1 main scanning (for example, second main scanning P2) is greater than the usage rate of the ink 66 in the M-th main scanning PM.

Figure 11:
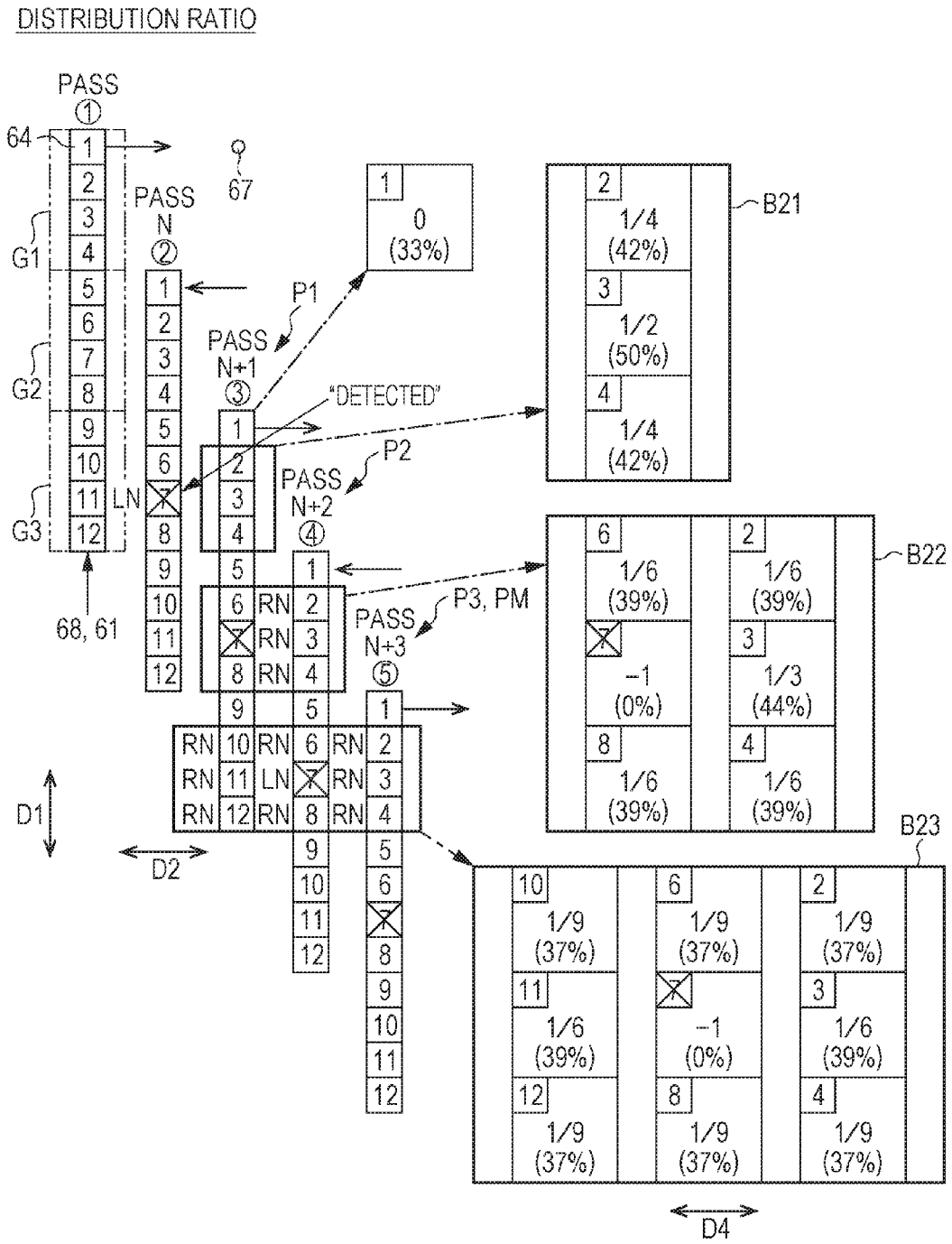
FIG. 11 is a diagram schematically illustrating an example of the distribution ratio for forming the complementary dot and the usage rate of ink after distribution.

FIG. 11 schematically illustrates the distribution ratio of the used amount of the ink 66 for forming the complementary dot DT10 in a case in which the 7-th nozzle becomes the defective nozzle LN, and an example of the usage rate of the ink 66 after the distribution. In right side of FIG. 11, a ratio in which the used amount of the ink to be discharged using the defective nozzle LN is distributed to the maximum eight complementary nozzles RN inside the blocks B21 to B23, and hereinafter, the usage rate which is a usage rate corresponding to the distribution ratio is added to the original ink usage rate of substantially 33% is illustrated by parentheses. Here, also, when the first raster complementary nozzle RN1 is used, the distribution ratio with respect to the first complementary nozzle RN1 is greater than the distribution ratio with respect to the second raster complementary nozzle RN2.

When detecting that the 7-th nozzle becomes the defective nozzle LN before printing, the distribution ratio with respect to each of the complementary nozzles RN becomes the distribution ratio illustrated in the block B23. Here, as illustrated in FIGS. 10 and 11, the 7-th nozzle becomes the defective nozzle LN in the pass N=2. When a dot formation of the printing region AP13 is complete the pass 3 (the first main scanning P1) performed after the defective nozzle LN is detected, the 5-th, 6-th, 8-th to 12-th nozzles which are already used cannot be used for the dot complementing. Here, in the complementary nozzle RN, the 3-rd nozzle (first raster complementary nozzle RN1) inside the block B21 in the pass 3, and the 2-nd and 4-th nozzles (second raster complementary nozzle RN2) are used. As illustrated in FIG. 11, as the distribution ratio of the used amount of the ink 66 for forming the complementary dot DT10, the 3-rd nozzle is ½, and the 2-nd and 4-th nozzles are ¼. For this reason, the ink usage rate of the 3-rd nozzle is substantially 50%, and the ink usage rates of the 2-nd and 4-th nozzles are substantially 42%. FIG. 10 illustrates the complementary dot DT11 is formed on the pixel PX102 of the first raster RA1 using the 3-rd nozzle in the pass 3. In addition, the ink droplets from the 2-nd nozzle in the pass 3 are added to the ink droplets from the 10-th nozzle in the pass 1 so that the complementary dot DT12 is formed on the second raster RA2, therefore, it is illustrated that the complementary dot DT12 in which a size thereof is increased is formed on the second raster RA2 using the 4-th nozzle in the pass 3.

When a dot formation of the printing region AP14 in the pass 4 (second main scanning P2) is complete, in the complementary nozzle RN, the 3-rd nozzle (first raster complementary nozzle RN1) inside the block B22 in the passes 3 and 4, and the 6-th, 2-nd, 8-th, and 4-th nozzles (second raster complementary nozzle RN2) are used. As illustrated in FIG. 11, as the distribution ratio of the used amount of the ink 66 for forming the complementary dot DT10, the 3-rd nozzle is ⅓, the 6-th, 2-nd, 8-th, and 4-th nozzles are ⅙. For this reason, the ink usage rate in the 3-rd nozzle is substantially 44%, and the ink usage rates of the 6-th, 2-nd, 8-th, and 4-th nozzles are substantially 39%. FIG. 10 illustrates that the complementary dot DT11 is formed on the pixel PX103 of the first raster RA1 using the 3-rd nozzle in the pass 4. In addition, the ink droplets discharged from the 6-th nozzle in the pass 3 is added to the ink droplets discharged from the 10-th nozzle in the pass 2 so that the complementary dot DT12 is formed on the second raster RA2, therefore, it is illustrated that the complementary dot DT12 in which a size thereof is increased is formed on the second raster RA2 using the 4-th nozzle in the pass 4.

The pass 5 (third main scanning P3) is also the M-th main scanning PM, and the dot complementing is performed at a distribution ratio (ink usage rate) same as a distribution ratio in a case in which the 7-th nozzle becomes the defective nozzle LN before printing. In the pass after the pass 6, the dot complementing is performed at the same distribution ratio (ink usage rate) if the defective nozzle LN is not newly detected the pass 5.

As illustrated in FIG. 11, for example, the distribution ratio in the 3-rd nozzle is ½ of a time of the first main scanning P1, is ⅓ of a time of the second main scanning P2, is ⅙ of a time of the third main scanning P3 (M-th main scanning PM), and is ⅙ even after the pass N+M+1. The distribution ratio of the 2-nd nozzle is ¼ of a time of the first main scanning P1, is ⅙ of a time of the second main scanning P2, is ⅛ of a time of the third main scanning P3 (M-th main scanning PM), and is ⅛ even after the pass N+M+1. Therefore, the distribution ratio of the used amount of the ink 66 for forming the complementary dot DT10 is satisfied expressions described below.

"Distribution ratio of first main scanning">"Distribution ratio of *M*-th main scanning" (1A)

"Distribution ratio of first main scanning">"Distribution ratio of second main scanning" (2A)

"Distribution ratio of second main scanning">"Distribution ratio of third main scanning" (3A)

"Distribution ratio of $M$-th main scanning"="Distribution ratio of $M+m$-th scanning" (4A)

When the usage rate of the ink 66 after the distribution is converted, the usage rate of the 3-rd nozzle is substantially 50% of a time of the first main scanning P1, is substantially 44% of a time of the second main scanning P2, is substantially 39% of a time of the third main scanning P3 (M-th main scanning PM), and is substantially 39% after the pass N+M+1. The usage rate of the 2-nd nozzle is substantially 42% of a time of the first main scanning P1, is substantially 39% of a time of the second main scanning P2, is substantially 37% of a time of the third main scanning P3 (M-th main scanning PM), and is substantially 37% even after the pass N+M+1. Therefore, the usage rate of the ink 66 after the distribution is satisfied with expressions described below.

"Ink usage rate of first main scanning">"Ink usage rate of $M$-th main scanning" (5A)

"Ink usage rate of first main scanning">"Ink usage rate of second main scanning" (6A)

"Ink usage rate of second main scanning">"Ink usage rate of third main scanning" (7A)

"Ink usage rate of $M$-th main scanning"="Ink usage rate of $M+m$-th scanning" (8A)

Even in the 4-th nozzle, the expressions are same.

The 6-th and 8-th nozzles used in the block B22 is satisfied with relation expressions (1A), (2A), (4A), (5A), (6A), and (8A).

In order to realize the distribution ratio and the ink usage rate described above, for example, in addition to the distribution tables 251 to 255 illustrated in FIG. 9, a distribution table of 42% which is not illustrated can be used. The distribution table of 42% is a distribution table for generating dot data allocated to the 2-nd and 4-th nozzles in the block B21 illustrated in FIG. 11, and corresponds to the ink usage rate of substantially 42%. A generation amount of dots of the distribution table of 42% is greater than a generation amount of dots of the distribution table 251 of 33% at the ink usage rate of substantially 42%/33%.

5. Specific Example In A Case In Which Defective Nozzle Is In Third Group

Figure 12:
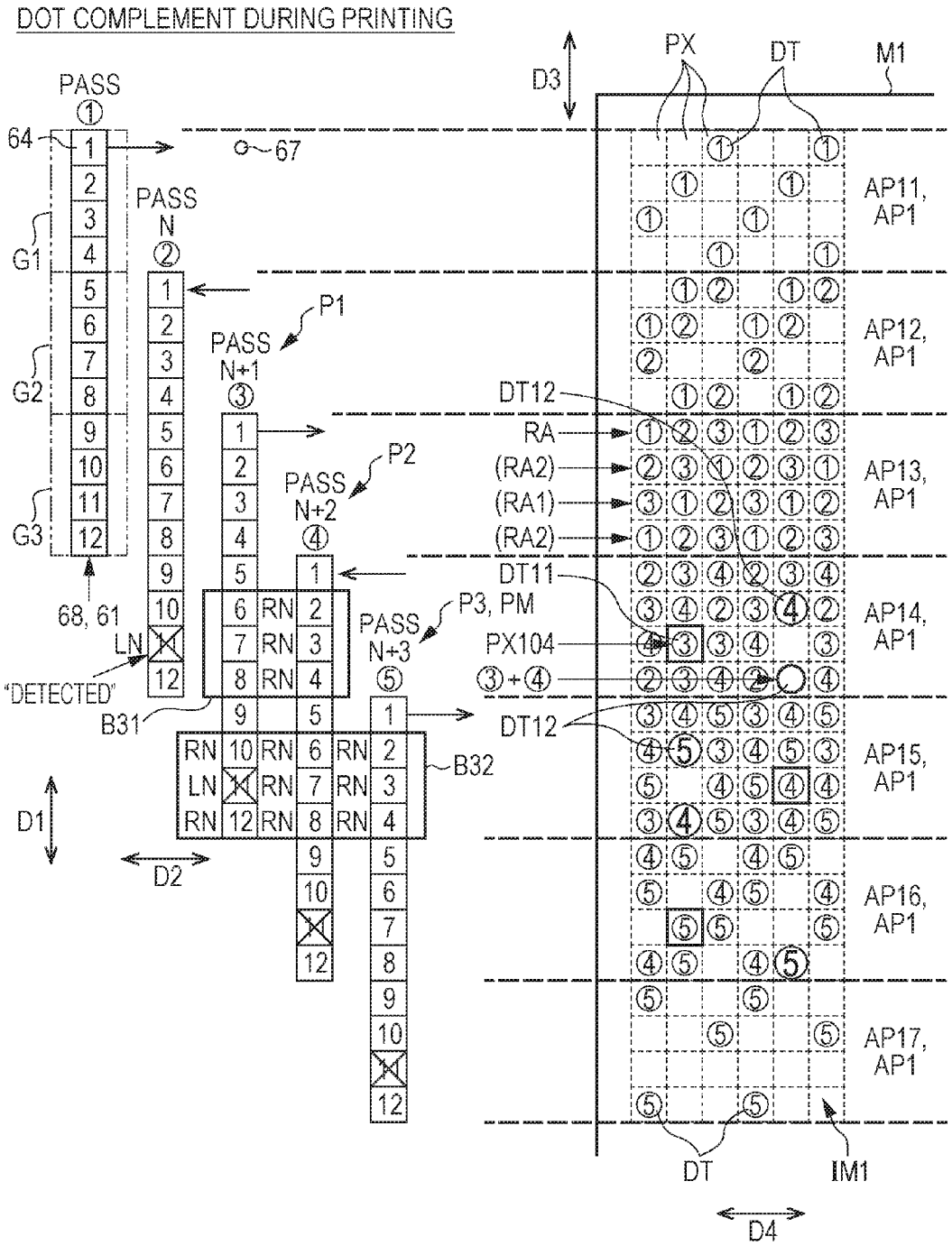
FIG. 12 is a diagram schematically illustrating an example of the distribution ratio of the used amount of ink for forming the complementary dot when detecting that an eleventh nozzle is a defective nozzle during printing and the usage rate of ink after the distribution.

FIG. 12 schematically illustrates an example in which the 11-th nozzle of the third group during printing (for example, pass 2) becomes the defective nozzle LN. In this case, in the dot complementing with respect to the 11-th nozzle in the pass 2, the 1-st to 8-th nozzles in the passes 3 and 4 can be used. However, the 9-th, 10-th, and the 12-th nozzles used for the pass 2 cannot be used for the dot complementing. In the dot complementing with respect to the 11-th nozzle in the pass 3, all of the complementary nozzles RN inside the block B32 in which all dots are formed due to the M-th main scanning PM can be used. Here, regarding the usage rate of the ink 66 discharged using the same complementary nozzle RN, the usage rate of the ink 66 from the first main scanning P1 to the M−1 main scanning (for example, second main scanning P2) is adjusted to be greater than the usage rate of the ink 66 in the M-th main scanning PM.

Figure 13:
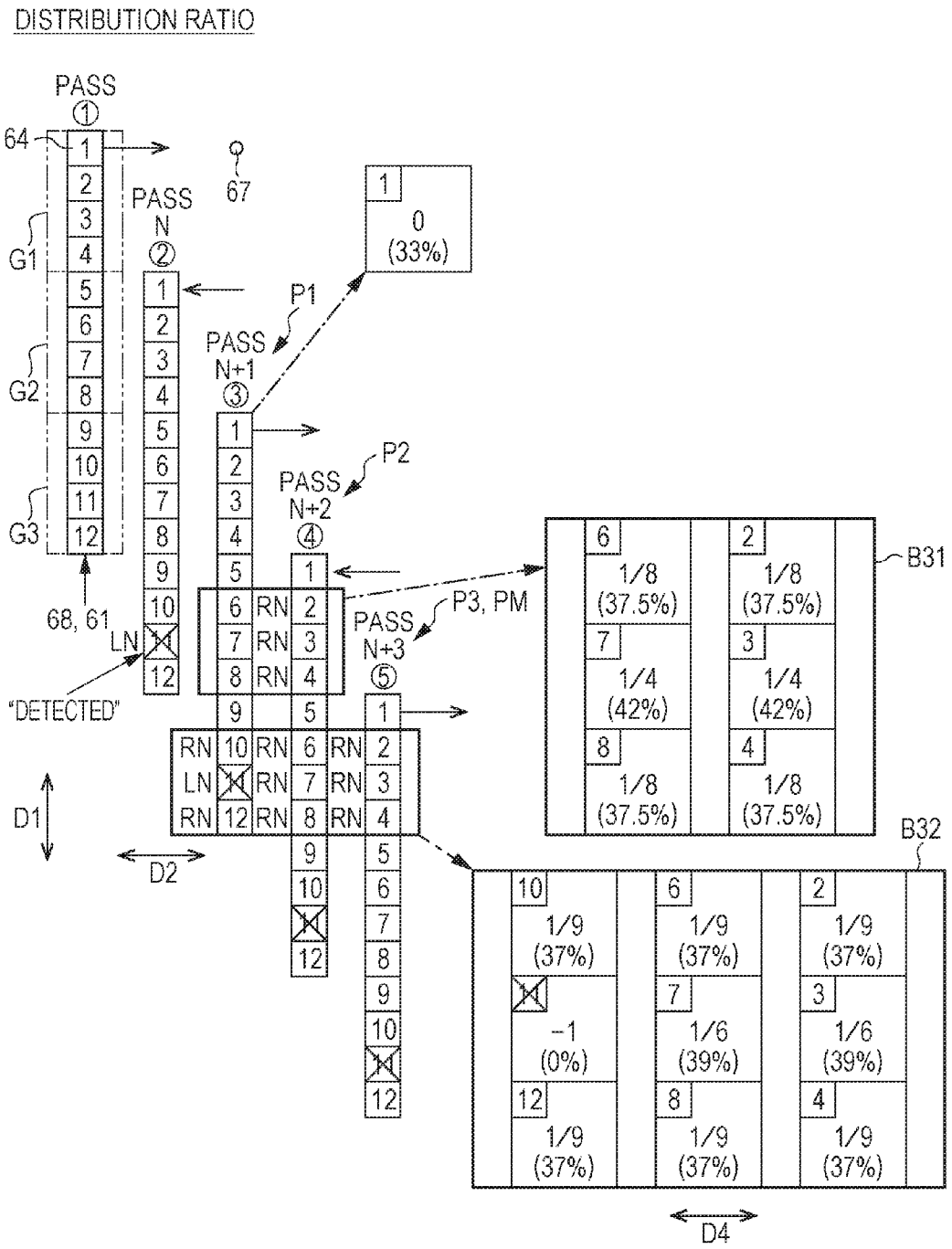
FIG. 13 is a diagram schematically illustrating an example of the distribution ratio for forming the complementary dot and the usage rate of ink after the distribution.

FIG. 13 schematically illustrates, when the 11-th nozzle becomes the defective nozzle LN, the distribution ratio of the used amount of the ink 66 for forming the complementary dot DT10, and an example of the usage rate of the ink 66 after the distribution. In a left side of FIG. 13, a ratio in which the used amount of the ink to be discharged from the defective nozzle LN is distributed to the maximum eight complementary nozzles RN inside the blocks B31 and B32 is illustrated, and hereinafter, a usage rate in which the usage rate corresponding to the distribution ratio is added to substantially 33% of the original ink usage rate is illustrated by parentheses. Even in here, when the first raster complementary nozzle RN1 is used, the distribution ratio with respect to the first raster complementary nozzle RN1 is greater than the distribution ratio with respect to the second raster complementary nozzle RN2.

When the 11-th nozzle becomes the defective nozzle LN before printing is detected, the distribution ratio with respect to each of the complementary nozzles RN becomes the distribution ratio illustrated in the block B32. Here, as illustrated in FIGS. 12 and 13, the 11-th nozzle becomes the defective nozzle LN in the pass N=2. When a dot formation of the printing region AP14 in the pass 3 (first main scanning P1) performed after the defective nozzle LN is detected is complete, the 9-th, 10-th, and 12-th nozzles which are already used cannot be used for the dot complementing. Here, in the passes 3 and 4, the 7-th and 3-rd nozzles (first raster complementary nozzle RN1) inside the block B31, and the 6-th, 2-nd, 8-th, and 4-th nozzles (second raster complementary nozzle RN2) are used. As illustrated in FIG. 13, as the distribution ratio of the used amount of the ink 66 for forming the complementary dot DT10, the 7-th and 3-rd nozzles are ¼, the 6-th, 2-nd, 8-th, and 4-th nozzles are ⅛. For this reason, the ink usage rates of the 7-th and 3-rd nozzles are substantially 42%, and the ink usage rates of the 6-th, 2-nd, 8-th, and 4-th nozzles are substantially 37.5%. FIG. 12 illustrates that the complementary dot DT11 is formed on the pixel PX104 of the first raster RA1 using the 7-th nozzle in the pass 3. In addition, the complementary dot DT12 in which a size thereof is increased is formed on the second raster RA2 using the 2-nd nozzle in the pass 4, and the ink droplets discharged from the 4-th nozzle in the pass 4 is added to the ink droplets discharged from the 8-th nozzle in the pass 3 so that the complementary dot DT12 is formed on the second raster RA2.

The pass 5 (third main scanning P3) is the M-th main scanning PM, the dot complementing is performed at the distribution ratio (the ink usage rate) same as in a case of detecting that the 11-th nozzle becomes the defective nozzle LN before printing. In the pass after the pass 6, when the defective nozzle LN is newly detected, the dot complementing is performed at the distribution ratio (ink usage rate) same as in the pass 5.

As illustrated in FIG. 13, for example, the distribution ratio of the 7-th nozzle is ¼ of a time of the first main scanning P1, is ⅙ of a time of the second main scanning P2 and the third main scanning P3 (M-th main scanning PM), and is also ⅙ after the pass N+M+1. The distribution ratio of the 6-th nozzle is ⅛ of a time of the first main scanning P1, is ⅑ of a time of the second main scanning P2 and the third main scanning P3 (M-th main scanning PM), and is also ⅑ after the pass N+M+1. Therefore, the distribution ratio of the used amount of the ink 66 of for forming the complementary dot DT10 is satisfied with a relationship as described below.

"Distribution ratio of first main scanning">"Distribution ratio of $M$-th main scanning" (1B)

"Distribution ratio of first main scanning">"Distribution ratio of second main scanning" (2B)

"Distribution ratio of $M$-th main scanning"="Distribution ratio of $M+m$-th scanning" (4B)

When the usage rate of the ink 66 after the distribution is changed, the usage rate of the 7-th nozzle is substantially 42% of a time of the first main scanning P1, is substantially 39% of a time of the second main scanning P2, and the third main scanning P3 (M-th main scanning PM), and is also substantially 39% after the pass N+M+1. The usage rate of the 6-th nozzle is substantially 37.5% of a time of the first main scanning P1, is substantially 37% of a time of the second main scanning P2 and the third main scanning P3 (M-th main scanning PM), and is also substantially 37% after the pass N+M+1. Therefore, the usage rate of the ink 66 after the distribution is satisfied with a relationship described below.

"Ink usage rate of first main scanning">"Ink usage rate of *M*-th main scanning" (5B)

"Ink usage rate of first main scanning">"Ink usage rate of second main scanning" (6B)

"Ink usage rate of M-th main scanning"="Ink usage rate of *M*+*m*-th scanning" (8B)

Even in the 3-rd, 2-nd, 8-th, and 4-th nozzles, the expressions are same.

In order to realize the distribution ratio and the ink usage rate described above, for example, in addition to the distribution tables 251, 252, and 253 illustrated in FIG. 9, a distribution table of 37.5% and a distribution table of 42% which are not illustrated can be used. The distribution table of 37.5% is a distribution table for generating dot data allocated to the 6-th, 2-nd, 8-th, and 4-th nozzles in the block B31 illustrated in FIG. 13, and correspond to the ink usage rate of substantially 37.5%. A generation amount of dots of the distribution table of 37.5% is greater than a generation amount of dots of the distribution table 251 of 33% at the ink usage rate of substantially 37.5%/33%.

6. Modification Example

The invention is considered as various modification examples.

The printing section described above performs bidirectional printing; however, the technology can also be adopted to a printing section which performs single direction printing.

In addition, the printing section as described above performs three-pass printing; however, the technology can also be adopted to a printing section which performs multipath printing such as four-pass, or more printing or a printing section which performs two-pass printing.

In the embodiment described above, the ink usage rate is converted by changing the distribution table; however, other than a change of the distribution table, the ink usage rate can be changed.

For example, it is assumed that the color conversion section 42 illustrated in FIG. 1 divides original RGB data into RGB data in each pass so as to generate the CMYK data in each pass, color conversion LUT corresponding to the ink usage rate of a plurality of steps is prepared, the CMYK data in each pass may be generated with reference to the color conversion LUT corresponding to a target ink usage rate. After that, when the dot distribution section 43 converts the CMYK data in each pass into the dot data in each pass, the halftone processing section 44 converts the dot data in each pass into the halftone data in each pass, and the driving signal transmission section 46 outputs the driving signal SG corresponding to the halftone data in each pass to the driving circuit 62 of the head 61, the dot complementing in which the ink usage rate from the first main scanning P1 to the M−1 main scanning is increased is performed.

In addition, it is assumed that the halftone data in each pass is generated using a pass disassemble mask corresponding to the pass with respect to the halftone data in each pass which is not disassembled, the pass disassemble mask corresponding to the ink usage rate of a plurality of steps is prepared, the halftone data in each pass may be generated using the pass disassemble mask corresponding to the target ink usage rate. When the driving signal transmission section 46 outputs the driving signal SG corresponding to the halftone data in each pass to the driving circuit 62 of the head 61, the dot complementing in which the ink usage rate from the first main scanning P1 to the M−1 main scanning is increased is performed.

Moreover, even a case in which the complementary nozzles RN do not include the second raster complementary nozzle RN2 but includes the first raster complementary nozzle RN1, or a case in which the complementary nozzles RN do not include the first raster complementary nozzle RN1 but include the second raster complementary nozzle RN2 is included in the technology, and thus basic effects of the technology can be obtained.

In addition, regarding the usage rate of ink discharged using the same complementary nozzle, even when the ink usage rate in the second main scanning and the ink usage rate in the third main scanning are same as each other, if the ink usage rate in the first main scanning is greater than the ink usage rate in the M-th main scanning, it is included in the technology, and thus the basic effects of the technology can be obtained.

Further, regarding the usage rate of ink discharged using the same complementary nozzle, even when the ink usage rate in the first main scanning and the ink usage rate in the second main scanning are same as each other, if the ink usage rate in the first main scanning is greater than the ink usage rate in the M-th main scanning, it is included in the technology, and thus the basic effects of the technology can be obtained.

7. Conclusion

As described above, according to the invention, a technology, or the like which can appropriately complement dots to be formed using the defective nozzle by various aspects can be provided. Of course, the basic actions and effects described above can be obtained even in a technology which does not include a configuration condition relating to dependent claims but includes only a configuration condition relating to independent claims, or the like.

In addition, a configuration in which each configuration disclosed in the embodiments and modification example described above is substituted to each other or a combination thereof is changed, a configuration in which a known technology and each configuration disclosed in the embodiments and modification example described above are substituted to each other or a combination thereof is changed, and the like can also be carried out. The invention also includes these configurations described above.

The entire disclosure of Japanese Patent Application No. 2015-022929, filed Feb. 9, 2015 is expressly incorporated by reference herein.

What is claimed is:

1. A printing control apparatus for a printing section that includes:

a main scanning section that, during a main scanning operation, causes relative movement of a print head with respect to a print medium in a main scanning direction; and a sub-scanning section that, during a sub-scanning operation, causes relative movement of the print medium with respect to the print head in a sub-scanning direction that intersects the main scanning direction;

wherein the printing section forms dots of a raster in the main scanning direction, the dots being formed by performing the main scanning operation M times (M is integer of two or more) and by performing the sub-scanning operation;

the printing control apparatus comprising:

said print head, the print head being formed of a plurality of nozzles aligned in a predetermined direction for discharging ink, the predetermined direction intersecting the main scanning direction;

a defective nozzle detecting section that detects a defective nozzle included in the plurality of nozzles; and a complementing section that causes complementary nozzles included in the plurality of nozzles to discharge complementary dots which complement dots of a first raster to be recorded using the defective nozzle, and forms the complementary dots on at least one of a second raster and the first raster, at least one of the complementary nozzles not being physically adjacent to the defective nozzle;

wherein the complementing section includes an adjusting section that sets a main scanning operation to be performed after the defective nozzle is detected as a first main scanning, sets a main scanning operation to be performed M times after the defective nozzle is detected as an M-th main scanning, and adjusts a usage rate of ink discharged using the same complementary nozzle that discharges the ink in each of the first main scanning and the M-th main scanning such that the usage rate of the ink discharged from the same complementary nozzle in the first main scanning is greater than the usage rate of the ink discharged from the same complementary nozzle in the M-th main scanning, wherein the adjusting section sets a main scanning operation after the first main scanning as a second main scanning, and allows the usage rate of ink in the first main scanning to be greater than the usage rate of ink in the second main scanning, regarding the usage rate of ink discharged using the same complementary nozzle, wherein the M-th means three times or more, and wherein the adjusting section sets a main scanning operation after the second main scanning as a third main scanning, and allows the usage rate of ink in the second main scanning to be greater than the usage rate of ink in the third main scanning, regarding the usage rate of ink discharged using the same complementary nozzle.

2. The printing control apparatus according to claim 1, wherein the adjusting section allows the usage rate of ink in a main scanning operation after the M-th main scanning to be constant, regarding the usage rate of ink discharged using the same complementary nozzle.

3. The printing control apparatus according to claim 1, wherein the complementary nozzles are a plurality of complementary nozzles including a first raster complementary nozzle for forming the complementary dot on the first raster, and a second raster complementary nozzle for forming a complementary dot on the second raster, and wherein, in the same main scanning operation, the adjusting section allows the usage rate of ink discharged per dot using the first raster complementary nozzle to be greater than the usage rate of ink per dot discharged using the second raster complementary nozzle.

4. A printing control method for a printing section that includes:

a main scanning section that, during a main scanning operation, causes relative movement of a print head with respect to a print medium in a main scanning direction; and a sub-scanning section that, during a sub-scanning operation, causes relative movement of the print medium with respect to the print head in a sub-scanning direction that intersects the main scanning direction;

wherein the printing section forms dots of a raster in the main scanning direction, the dots being formed by performing the main scanning operation M times (M is integer of two or more) and performing the sub-scanning operation, the print control method comprising:

providing said print head, the print head being formed of a plurality of nozzles aligned in a predetermined direction for discharging ink, the predetermined direction intersecting the main scanning direction;

detecting a defective nozzle included in the plurality of nozzles; and causing complementary nozzles included in the plurality of nozzles to discharge complementary dots which complement dots of a first raster to be recorded using the defective nozzle, and forming the complementary dots on at least one of a second raster and the first raster, at least one of the complementary nozzles not being physically adjacent to the defective nozzle, wherein the causing and the forming include a setting main scanning step that sets a main scanning operation that is performed after the defective nozzle is detected as a first main scanning, sets a main scanning operation that is performed M times after the defective nozzle is detected as an M-th main scanning, and adjusts a usage rate of ink discharged using the same complementary nozzle that discharges the ink in each of the first main scanning and the M-th main scanning such that the usage rate of the ink discharged from the same complementary nozzle in the first main scanning is greater than the usage rate of the ink discharged from the same complementary nozzle in the M-th main scanning, wherein the setting main scanning step further sets a main scanning operation after the first main scanning as a second main scanning, and allows the usage rate of ink in the first main scanning to be greater than the usage rate of ink in the second main scanning, regarding the usage rate of ink discharged using the same complementary nozzle, wherein the M-th means three times or more; and wherein the setting main scanning step further sets a main scanning operation after the second main scanning as a third main scanning, and allows the usage rate of ink in the second main scanning to be greater than the usage rate of ink in the third main scanning, regarding the usage rate of ink discharged using the same complementary nozzle.

5. The printing control apparatus according to claim 1, wherein the adjustment section of the complementing section allows the usage rate of ink per dot of the complementary nozzle in the first main scanning to be greater than a usage rate of ink per dot of the complementary nozzle in the M-th main scanning.

6. The printing control apparatus according to claim 1, wherein the adjustment section allows the usage rate of ink per dot of the complementary nozzle in the first main scanning operation to be greater than the usage rate of ink per dot of the complementary nozzle in the second main scanning operation.

7. The printing control apparatus according to claim 1, wherein the adjustment section allows the usage rate of ink per dot of the complementary nozzle in the second main scanning to be greater than the usage rate of ink per dot of the complementary nozzle in the third main scanning.

8. The printing control apparatus according to claim 2, wherein the adjusting section allows the usage rate of ink per dot of the complementary nozzle in the main scanning after the M-th main scanning to be constant.

9. A printing control apparatus for a printing section that includes:

a main scanning section that, during a main scanning operation, causes relative movement of a print head with respect to a print medium in a main scanning direction; and a sub-scanning section that, during a sub-scanning operation, causes relative movement of the print medium with respect to the print head in a sub-scanning direction that intersects the main scanning direction;

wherein the printing section forms dots of a raster in the main scanning direction, the dots being formed by performing the main scanning operation M times (M is integer of two or more) and by performing the sub-scanning operation;

the printing control apparatus comprising:

said print head, wherein the print head is formed of a plurality of nozzles aligned in a predetermined direction for discharging ink, the predetermined direction intersecting the main scanning direction;

a defective nozzle detecting section that detects a defective nozzle included in the plurality of nozzles; and a complementing section that forms a complementary dot which complements dots of a first raster to be recorded using the defective nozzle on at least one of a second raster and the first raster using a complementary nozzle included in the plurality of nozzles;

wherein the complementing section includes an adjusting section that sets a main scanning operation to be performed after the defective nozzle is detected as a first main scanning, sets a main scanning operation to be performed M times after the defective nozzle is detected as an M-th main scanning, and allows a usage rate of ink in the first main scanning to be greater than a usage rate of ink in the M-th main scanning, regarding the usage rate of ink discharged using the same complementary nozzle;

wherein the adjusting section sets a main scanning operation after the first main scanning as a second main scanning, and allows the usage rate of ink in the first main scanning to be greater than the usage rate of ink in the second main scanning, regarding the usage rate of ink discharged using the same complementary nozzle;

wherein the M-th means three times or more; and wherein the adjusting section sets a main scanning operation after the second main scanning as a third main scanning, and allows the usage rate of ink in the second main scanning to be greater than the usage rate of ink in the third main scanning, regarding the usage rate of ink discharged using the same complementary nozzle.

* * * * *